US005969730A

United States Patent [19]

Inose et al.

[11] Patent Number: 5,969,730

[45] **Date of Patent: *Oct. 19, 1999**

[54] PRINTER

[75] Inventors: Shigeru Inose, Ibaraki-ken; Fumio Miyahara, Sagamihara; Hideaki Kishida, Kawasaki; Yasuhiro Hamada, Yokohama, all of Japan

[73] Assignee: Canon Aptex Inc., Mitsukaido, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/556,852

[22] Filed: Nov. 2, 1995

[30] Foreign Application Priority Data

| | | | |
|---|---|---|---|
| Nov. 7, 1994 | [JP] | Japan | 6-272547 |
| Nov. 7, 1994 | [JP] | Japan | 6-272549 |
| Nov. 7, 1994 | [JP] | Japan | 6-272550 |

[51] Int. Cl.[6] ..... B41J 29/38; B41J 19/30

[52] U.S. Cl. ..... 347/14; 347/13; 347/17; 400/323

[58] Field of Search ..... 347/14, 13, 17, 347/35, 19, 248; 346/1.1, 140; 400/323, 279

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,806,950 | 2/1989 | Sekine et al. . | |
| 4,835,549 | 5/1989 | Samejima et al. . | |
| 4,908,635 | 3/1990 | Iwasawa et al. . | |
| 5,036,337 | 7/1991 | Rezanka . | |
| 5,043,748 | 8/1991 | Katayama et al. | 346/140 R |
| 5,057,854 | 10/1991 | Pond et al. . | |
| 5,107,276 | 4/1992 | Kneezel et al. . | |
| 5,172,134 | 12/1992 | Kishida et al. . | |
| 5,173,717 | 12/1992 | Kishida et al. | 346/1.1 |
| 5,285,220 | 2/1994 | Suzuki et al. | 346/140 |
| 5,353,051 | 10/1994 | Katayama et al. | 347/13 |
| 5,475,405 | 12/1995 | Widder et al. . | |
| 5,504,507 | 4/1996 | Watrobski et al. . | |
| 5,798,772 | 8/1998 | Tachihara et al. . | |

FOREIGN PATENT DOCUMENTS

| | | |
|---|---|---|
| 0373894 | 6/1990 | European Pat. Off. . |
| 0496525 | 7/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 1-127361 | 5/1989 | Japan . |
| 3-227643 | 10/1991 | Japan . |
| 3-246049 | 11/1991 | Japan . |
| 5220963 | 8/1993 | Japan . |
| WO90 03554 | 4/1990 | WIPO . |
| WO90 10541 | 9/1990 | WIPO . |

*Primary Examiner*—Peter S. Wong
*Assistant Examiner*—Rajnikant B. Patel
*Attorney, Agent, or Firm*—Fitzpatrick, Cella, Harper & Scinto

[57] ABSTRACT

A printer includes a full-line type printhead which can correct variations in the ink discharge amounts from the respective nozzles, and density unevenness of a printed image due to variations in the operations of many driving circuits in the printhead and changes in the internal temperature or a temperature gradient of the printhead, and can obtain a high-quality printed image without density unevenness in consideration of the print conditions and changes in operation environmental temperature. A pre-heating operation is performed by selecting an optimal pre-pulse signal for each nozzle of the printhead on the basis of information stored in an EEPROM of the printhead and pre-pulse selection data associated with each nozzle of the printhead. A heat signal is also generated to obtain a main pulse suitable for each IC of a printhead corresponding to an ink of each color. In addition, the internal temperature of the printhead or printing density information from the printhead is monitored. If the internal temperature or the printing density is high, control is performed to inhibit a pre-pulse selection signal from being output while applying pre-pulse and main pulse signals to each nozzle heater of the printhead, which is used for a print operation.

42 Claims, 28 Drawing Sheets

FIG. 7A
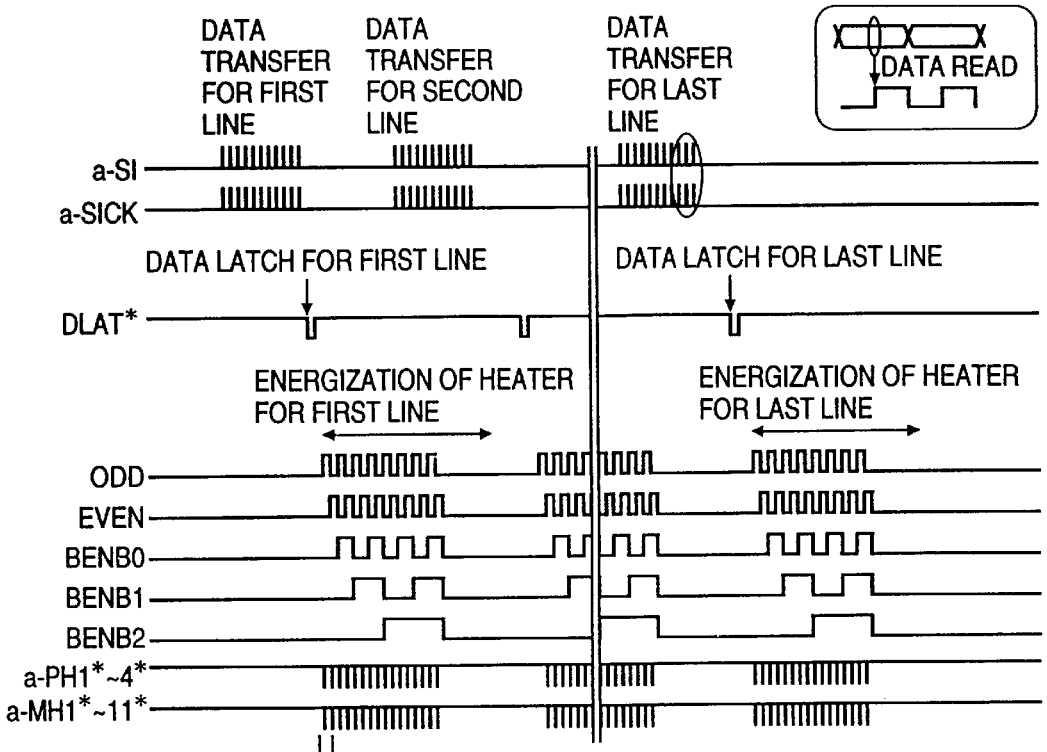
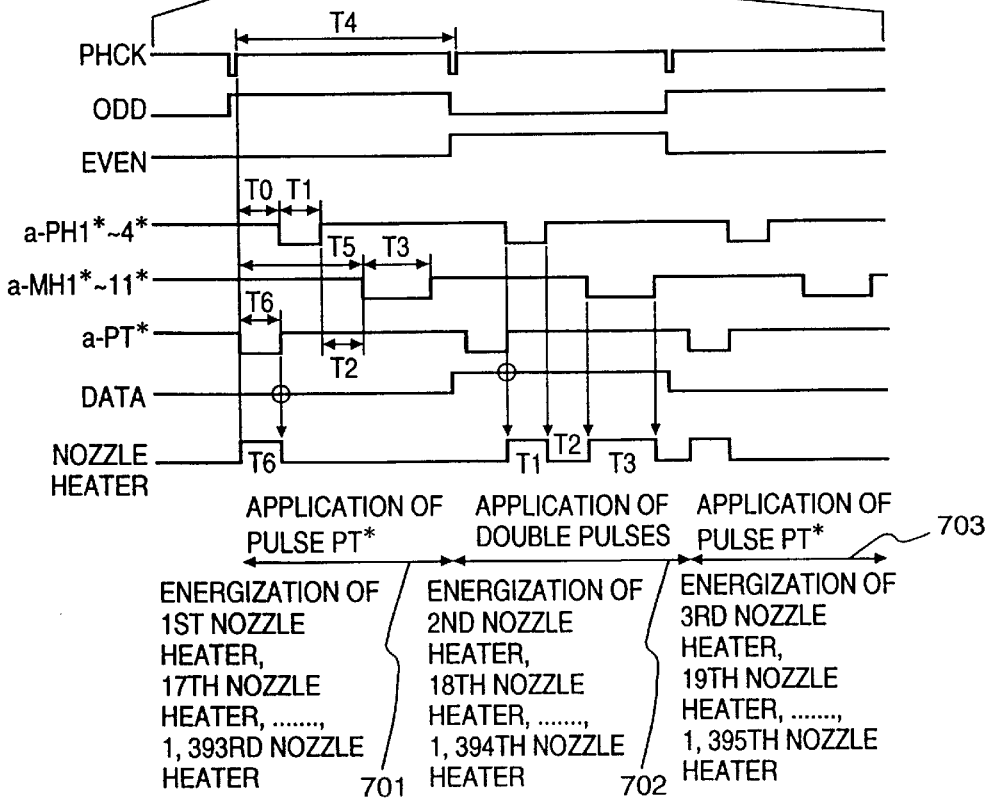
FIG. 7B

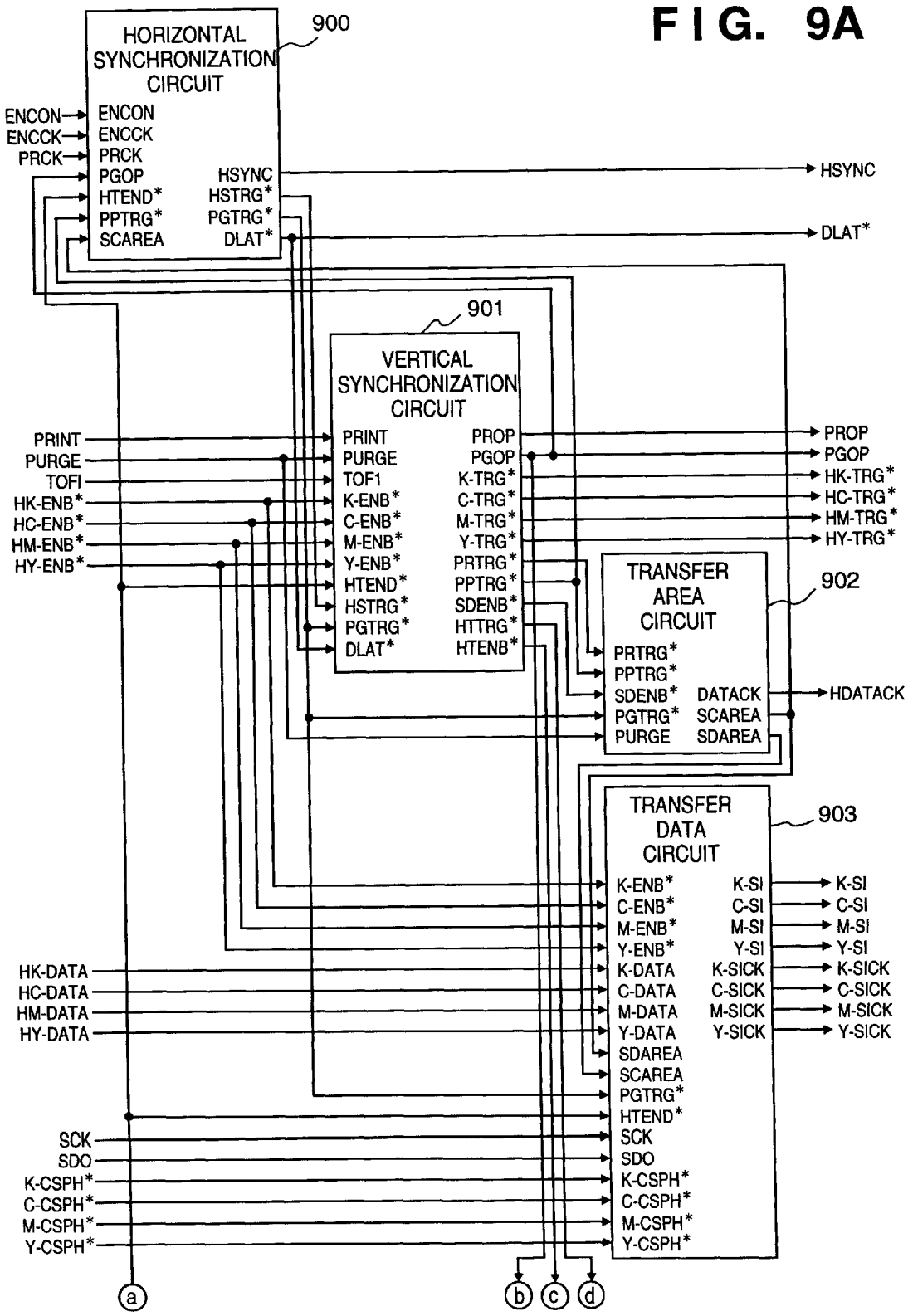
FIG. 9A
HORIZONTAL SYNCHRONIZATION CIRCUIT
900
ENCON
ENCCK
PRCK
PGOP
HTEND*
PPTRG*
SCAREA
HSYNC
HSTRG*
PGTRG*
DLAT*
HSYNC
DLAT*
VERTICAL SYNCHRONIZATION CIRCUIT
901
PRINT
PURGE
TOF1
K-ENB*
C-ENB*
M-ENB*
Y-ENB*
HTEND*
HSTRG*
PGTRG*
DLAT*
PROP
PGOP
K-TRG*
C-TRG*
M-TRG*
Y-TRG*
PRTRG*
PPTRG*
SDENB*
HTTRG*
HTENB*
PROP
PGOP
HK-TRG*
HC-TRG*
HM-TRG*
HY-TRG*
HK-ENB*
HC-ENB*
HM-ENB*
HY-ENB*
TRANSFER AREA CIRCUIT
902
PRTRG*
PPTRG*
SDENB*
PGTRG*
PURGE
DATACK
SCAREA
SDAREA
HDATACK
TRANSFER DATA CIRCUIT
903
K-ENB*
C-ENB*
M-ENB*
Y-ENB*
K-DATA
C-DATA
M-DATA
Y-DATA
SDAREA
SCAREA
PGTRG*
HTEND*
SCK
SDO
K-CSPH*
C-CSPH*
M-CSPH*
Y-CSPH*
K-SI
C-SI
M-SI
Y-SI
K-SICK
C-SICK
M-SICK
Y-SICK
HK-DATA
HC-DATA
HM-DATA
HY-DATA
SCK
SDO
K-CSPH*
C-CSPH*
M-CSPH*
Y-CSPH*
a
b
c
d (a = Y, M, C, K)

FIG. 19A
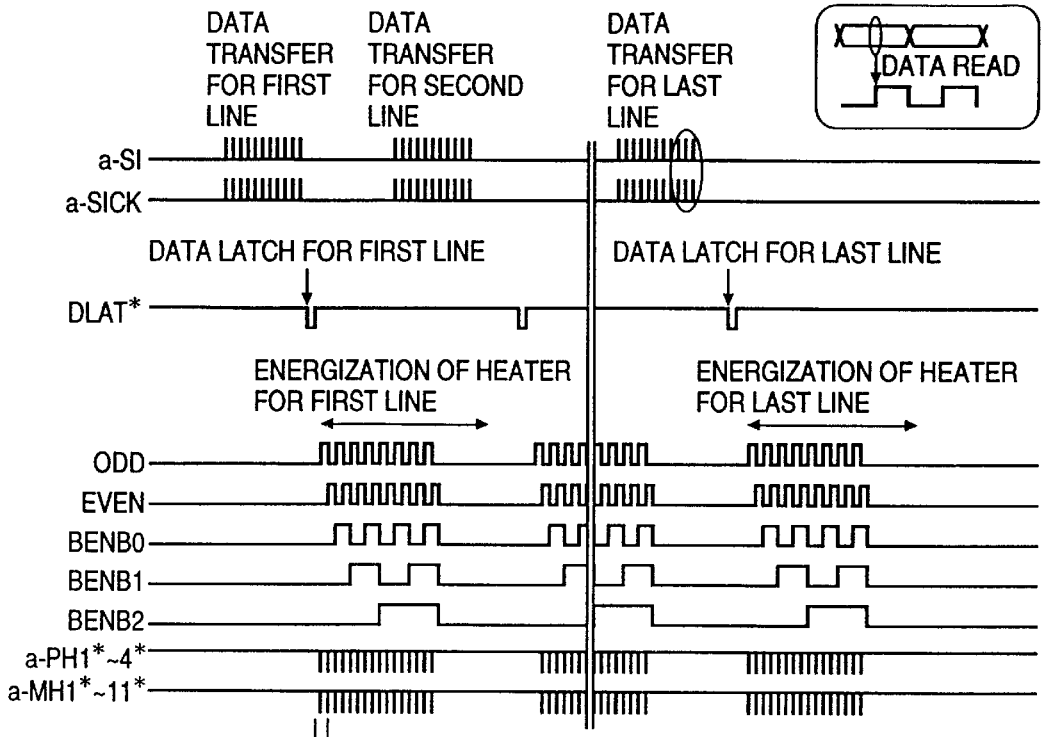
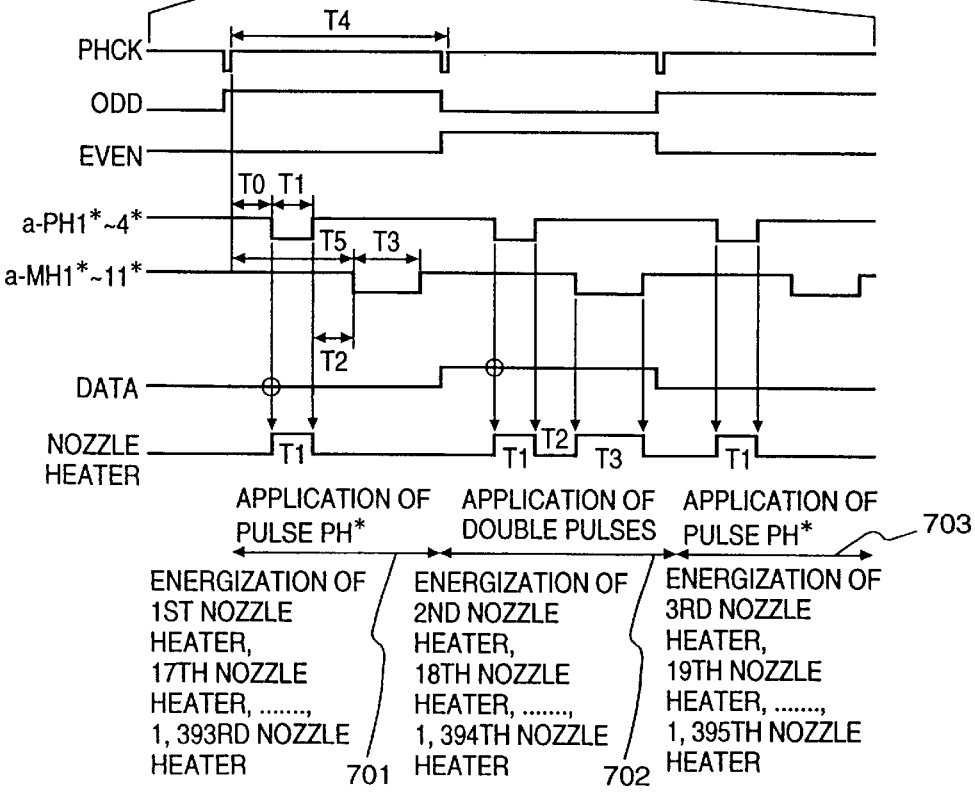
FIG. 19B

PRINTER

BACKGROUND OF THE INVENTION

This invention relates to a printer and, more particularly, to a printer for printing an image on a recording medium by using a line-type printhead.

A printhead mounted in a conventional ink-jet printer has a considerably smaller print width than printing paper. The printhead is therefore mounted in the printer to oppose printing paper, and a carriage on which the printhead is mounted is laterally moved to perform a serial print operation.

Density unevenness of a printed image in such a printhead is corrected by, for example, controlling the print operation of the printer by a reciprocal printing method.

As an effective printing method for a printhead mounted in a conventional ink-jet type printer, a double pulse control printing method is known. In this method, a short pulse is applied to each nozzle heater of the printhead first, and a long pulse is then applied to each nozzle heater.

In a line printer incorporating a full-line printhead having the same print width as that of printing paper, since the print width is large and the number of nozzles for discharging an ink is large, variations in ink discharge amount per orifice and the discharge direction cannot be neglected, unlike those in a printhead mounted in a serial printer like the above conventional printer. In addition, the line printer cannot employ the reciprocal printing method, which can be employed by the serial printer, owing to its structure.

Under the circumstances, a print control method different from that employed by the serial printer is required for the line printer to obtain a high-quality printed image free from density unevenness by making the ink discharge amounts from the ink discharge nozzles uniform.

Furthermore, in the line printer incorporating the full-line printhead described above, since a large number of nozzle heaters are also used, due to uneven energization of the nozzle heaters depending on the printing density, and changes in operating temperature, the internal temperature of the printhead cannot be kept constant for a proper print operation, resulting in variations in the ink discharge amounts from the respective nozzles. For this reason, it is difficult to maintain good print quality.

In the printer having the full-line printhead with the same print width as that of printing paper, since the structure of the printhead is different from that of a printhead having a small print width, printhead control is required in consideration of the following points to maintain high print quality:

(1) Since the nozzle heaters used for the ink discharge nozzles of the full-line printhead are driven by a plurality of LSIs, variations in ink discharge amount must be suppressed in units of LSIs in consideration of variations in the quality of LSIs.

(2) Control must be performed to suppress variations in ink discharge amount due to a temperature gradient in the printhead which is derived from a long print width.

(3) Control must be performed so as not to damage the nozzle heaters when large currents are supplied to the nozzle heaters to perform control operations (1) and (2).

SUMMARY OF THE INVENTION

Accordingly, it is an object of the present invention to provide a printer which can perform a high-image quality print operation even when a print operation is performed by using a full-line printhead having a long print width according to double pulse control.

According to the present invention, the foregoing object is attained by providing a printer including latch means for latching printing characteristic information associated with M print elements corresponding to M electrothermal transducers, respectively, in correspondence with the M electrothermal transducers to print an image on a recording medium by driving the M electrothermal transducers and the M print elements according to double pulse control; input means for inputting a plurality of pre-pulse signals; selection means for selecting an optimal pre-pulse signal for each of the M print elements on the basis of the plurality of pre-pulse signals input by the input means and the printing characteristic information latched by the latch means; pre-heat means for performing a pre-heating operation by sending an electricity to said M electrothermal transducers by using the optimal pre-pulse signals selected by the selection means; and a line-type printhead, comprising: output means for outputting the printing characteristic information to the printhead; and application means for applying a plurality of pre-pulse signals to the printhead.

In accordance with the present invention as described above, in the printer using the line-type printhead, when an image is to be printed on a recording medium by driving the M electrothermal transducers and M print elements corresponding to the electrothermal transducers, respectively, printing characteristic information associated with the M print elements are latched in correspondence with the M electrothermal transducers, optimal pre-pulse signals for the M print elements are selected on the basis of a plurality of input pre-pulse signals and the latched printing characteristic information, and a pre-heating operation is performed by sending an electricity to the M electrothermal transducers by using the selected pre-pulse signals. In this printer, printing characteristic information is output to the printhead, and a plurality of pre-pulse signals are also applied thereto.

It is another object of the present invention to provide a printer having a full-line printhead capable of maintaining high print quality.

According to the present invention, the foregoing object is attained by providing a printer for generating print image data by receiving print image data from an external device, and printing an image on a recording medium on the basis of the print image data by using a line-type printhead having a plurality of print elements, and driving the plurality of print elements by using N driving circuits, comprising: division control means for dividing the N driving circuits into M groups and performing control in units of groups; temperature measurement means for measuring the internal temperature of the printhead for each of the groups; driving means for driving the printhead through the N driving circuits to perform a print operation by applying a first pulse to each of said plurality of print elements, and applying a second pulse following the first pulse; first adjustment means for adjusting a width of the second pulse for each of the N driving circuits on the basis of variations in operations of the N driving circuits; and second adjustment means for adjusting a pulse interval of the first and second pulses on the basis of M internal temperatures measured by the temperature measurement means.

In accordance with the present invention as described above, when the printhead is driven through the N driving circuits to perform a print operation by applying the first pulse to each of the plurality of print elements and applying the second pulse thereto following the first pulse, the width of the second pulse is adjusted for each of the N driving circuits on the basis of the variations in the operations of the N driving circuits, and the pulse intervals of the first and second pulses are adjusted on the basis of the M measured internal temperatures obtained upon forming the N driving circuits into M groups.

It is still another object of the present invention to provide a printer which can always maintain good print quality without being influenced by print conditions such as the printing density and changes in temperature in the environment in which the printer is installed.

According to the present invention, the foregoing object is attained by providing a printer using a line-type printhead for printing an image on a recording medium by driving M electrothermal transducers and M print elements corresponding to the electrothermal transducers, respectively, according to double pulse control, comprising: monitoring means for monitoring an internal temperature of the printhead; input means for inputting print data; driving means for driving the printhead by sending an electricity to the M electrothermal transducers according to the double pulse control; and first control means for controlling the driving means to inhibit application of pre-pulse signals to the M electrothermal transducers on the basis of the internal temperature and a printing density obtained from the print data.

In accordance with the present invention as described above, control is performed to suppress application of pre-pulse signals to the M electrothermal transducers on the basis of the monitored internal temperature of the printhead and the printing density obtained from input print data.

The invention is particularly advantageous since variations in printing in units of print elements in the line-type printhead can be corrected. In addition, a deterioration in print quality due to variations in the operations of the N driving circuits or change in the internal temperature of the printhead can be corrected to maintain high print quality. Furthermore, since pulse control is performed upon completion of a print operation corresponding to one line during printing, no abnormal pulse is applied to each print element of the printhead. This protects the printhead and also prevents a deterioration in print quality due to application of abnormal pulses.

Moreover, since correction can be made to prevent variations in the print operations of the print elements due to changes in the internal temperature or printing density of the printhead, high print quality free from density unevenness can be obtained.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 7A to 7B comprise a timing chart showing a basic printing sequence in the printer in FIG. 1;

FIGS. 9A and 9B are block diagrams showing the arrangements of a head control unit 816 in the GAE 181;

FIGS. 19A to 19B comprise a timing chart showing a basic print sequence according to the third embodiment;

DETAILED DESCRIPTION OF THE PREFERRED EMBODIMENTS

Figure 1:
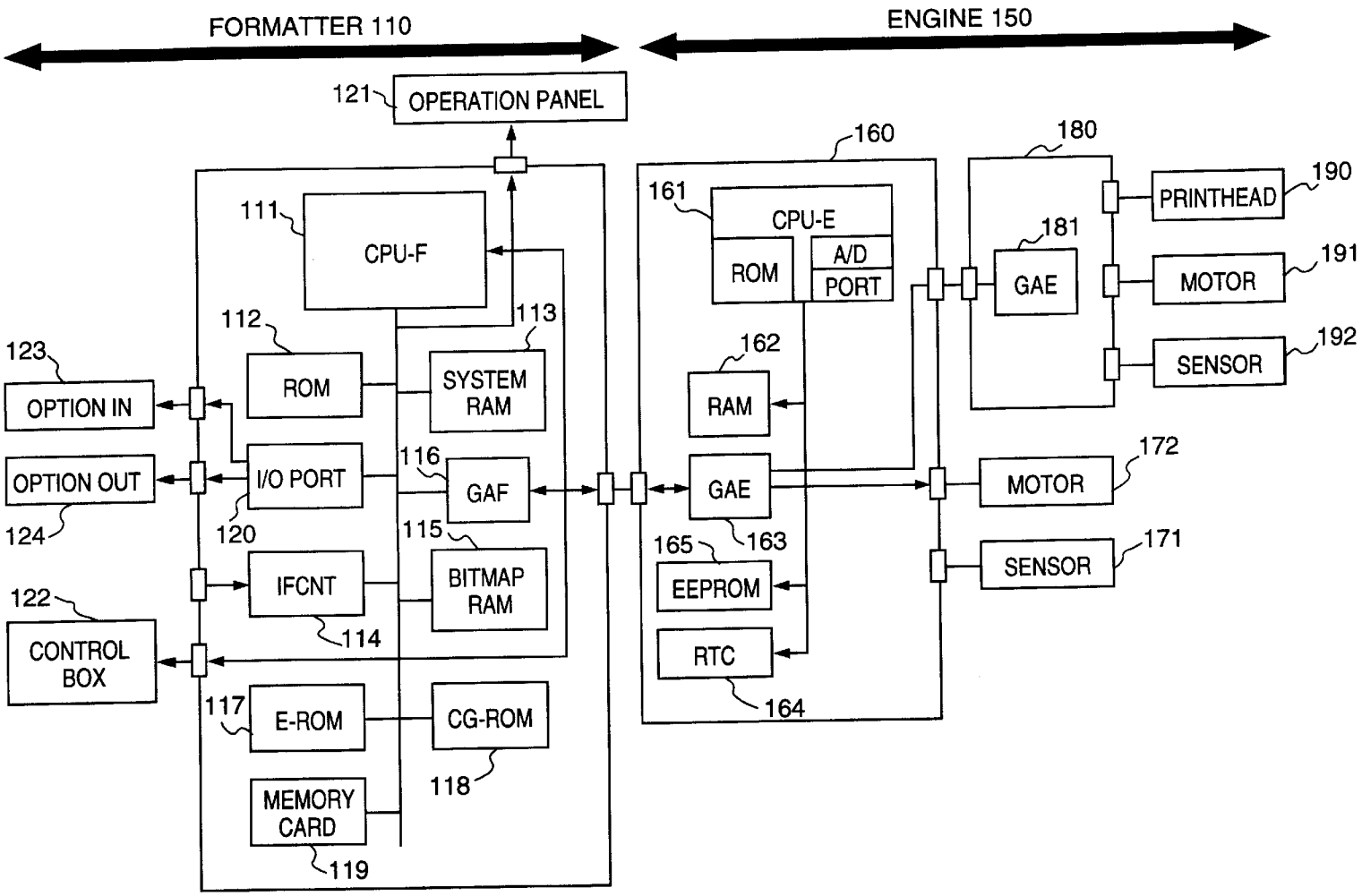
FIG. 1 is a block diagram showing the circuit arrangement of a color printer having full-line printheads based on an ink-jet method according to a typical embodiment of the present invention.

Preferred embodiments of the present invention will be described in detail below with reference to the accompanying drawings. A color printer incorporating a full-line printhead (to be referred to as printhead hereinafter) according to a typical example of the present invention will be briefly described first.

<Basic Printing Sequence>

Print data is transmitted to each printhead at the timing of a print operation for the preceding line. An engine detects this timing through a vertical registration adjustment counter, and transmits a trigger signal (a-TRG*; "*" indicates low true) for requesting print data to a formatter at the timing one line ahead of the print position. Upon detection of this signal, the formatter prepares for the transmission of the print data, and makes a vertical sync signal (a-ENB*), indicating the one-page data is being transferred, active. The engine transmits a print data reference clock signal (DATACK) to the formatter with a predetermined delay time with respect to the print data request signal. The formatter transmits the print data to the engine in synchronism with this reference clock signal. The engine directly transmits the received print data to the printhead.

The above operation is independently performed for each color signal except for the transmission of the reference clock signal to the formatter. The print data is therefore directly transferred from the formatter to the printhead. Consequently, the print data need not be temporarily stored in the engine.

With this operation, the transfer of the one-line print data is completed. When the one-line print data is transferred to the printhead, the engine makes a latch signal (DLAT*) active, and temporarily stores the data in the printhead. When printing paper is then conveyed and moved by one line, an ink corresponding to the print data for the first line is discharged to perform printing. Meanwhile, a print data request signal for the second line is output from the engine to the formatter, and the same print operation as that for the first line is performed.

Subsequently, the same print operation is repeated for the third and fourth lines. While the above vertical sync signal is active, a print data request signal is transmitted to the formatter for each line in accordance with the moving amount of printing paper. In this manner, the transfer of one-page print data is completed.

<Horizontal Registration Adjustment>

After a print data request signal becomes active, the engine uses a clock for transferring data to the printhead as a reference clock, and counts the sum total of unused nozzle heaters of the printhead and nozzles to be subjected to horizontal registration adjustment with reference clocks. After this count operation, the engine transfers reference clocks (DATACK) corresponding to the number of the print nozzle heaters to the formatter. Upon outputting the print data request signal, the engine counts reference clocks (CK) for horizontal registration adjustment for each color signal. After the count operation, the engine transfers reference clocks (a-SICK) corresponding to the total number of the nozzle heaters to the printhead. The formatter transfers print data (a-DATA) for each color in synchronism with the reference clocks (DATACK) transferred from the engine. The print data transferred to the engine in this manner is sent to the printhead through the engine.

With this operation, after the reference clocks for horizontal registration adjustment are input to the printhead for each color, the print data synchronized with the reference clocks is input to the printhead together with the reference clocks. Thereafter, clocks for horizontal registration adjustment are input to the printhead again, thereby allowing horizontal registration adjustment.

<Purge Operation during Printing>

In a line printer, while a given line is printed, data for the next line is sent to a printhead. In cleaning the printhead, therefore, the engine stops outputting the print data request signal one line before a head cleaning operation during printing. After the printhead cleaning operation is completed, the engine outputs the print data request signal. The data set when the purge operation is performed during printing is rewritten, and the print data set before the purge operation is stored in the printhead after the purge operation. With this operation, even if the printing paper moves and a data transfer request signal is output, printing can be properly performed.

[First Embodiment]

FIG. 1 is a block diagram showing the circuit arrangement of a color printer (to be referred to as a printer hereinafter) having full-line printheads based on the ink-jet printing method according to a first embodiment of the present invention. As shown in FIG. 1, the circuit of this printer is constituted by a formatter 110 for controlling communication with a host computer (to be referred to as a host hereinafter) and bitmapping data into a bitmap RAM, and an engine 150 for performing various control operations for the printheads and controlling a convey motor and various sensors.

This arrangement is designed for the following purpose. The formatter 110 requires a circuit arrangement corresponding to various applications (e.g., a facsimile apparatus and a copying machine as well as a printer) in consideration of different interfaces with the host and different image processing methods. In contrast to this, the engine 150 is designed to reduce differences dependent on applications, and is standardized to cope with any applications, thereby attaining a reduction in cost.

In this embodiment, the following functions are assigned to the formatter 110 and the engine 150.

(1) Functions of Formatter interfacing with the host analyzing a command sent from the host bitmapping print data into the bitmap RAM on the basis of the command control of an operation panel control of a control box (to be described later)

interfacing with the engine 150 option control: control (option IN) of a printing paper supply unit, and control (operation OUT) of printing paper discharge unit (2) Functions of Engine interfacing with the formatter 110 control of an ink supply subsystem control of a paper convey subsystem data transfer control for each printhead heater on/off control of each printhead temperature management timepiece function backup memory function printing paper width detection function In order to realize these functions, the following circuit arrangement is required.

Referring to FIG. 1, the formatter 110 is constituted by a CPU-F 111 for executing control programs, a ROM 112 for storing the control programs, a system RAM 113 for executing programs, an IFCNT 114 for communication with the host, a bit map RAM 115 for storing the bitmap data of print contents transmitted from the host, a circuit GAF 116 dedicated for controlling the bit map RAM 115 and performing communication with the engine 150, an emulation ROM (E-ROM) 117 for analyzing print data from the host, a character generator (CG-ROM) 118 for converting character code data into bitmap data, a memory card 119 used as an external memory, an I/O port 120 serving as an interface with the above option control functions, and an operation panel 121 serving as a user interface and including keys for various operations, an LCD for displaying a message from the printer, and the like.

Reference numeral 122 denotes a control box which serves as a user interface to perform various instruction input operations when this printer performs an image print operation by using image data stored in the memory card 119 in a stand-alone manner without being connected to the host; and 123 and 124, input/output interfaces (an option IN and an option OUT) with various apparatuses to be connected, as options, to the printer. In this embodiment, the printing paper supply unit (to be described later) is connected to the option IN 123, and the printing paper discharge unit (to be described later) is connected to the option OUT 124.

The engine 150 will be described next.

As shown in FIG. 1, the engine 150 is constituted by an engine circuit 160 mainly designed for a printing paper conveying operation, and an engine circuit 180 mainly designed for printhead driving control.

The engine 150 is constituted by a CPU-E 161 including a ROM for storing control programs, a RAM used as a work area to execute the programs, a port for receiving a signal from a sensor (to be described later), and an A/D converter for converting an analog input from the port into digital data, and adapted to execute the control programs to perform various control operations, a RAM 162 used when the CPU-E 161 executes a program, an EEPROM 163 for storing unevenness correction data for each printhead, a clock counter (RTC) 164, and a GAE 165 dedicated for generating test print data and performing communication with the formatter 110. Reference numeral 171 denotes a sensor for detecting the position of printing paper; and 172, a convey motor for conveying the printing paper.

The engine circuit 180 includes a circuit GAE 181 dedicated for driving/controlling a printhead 190, controlling a motor 191 for moving the printhead 190 and a cap (not shown) to cap the ink discharge nozzles of the printhead 190 when no print operation is performed, and controlling a sensor 192 for detecting the positions of the cap and the printhead.

Figure 2:
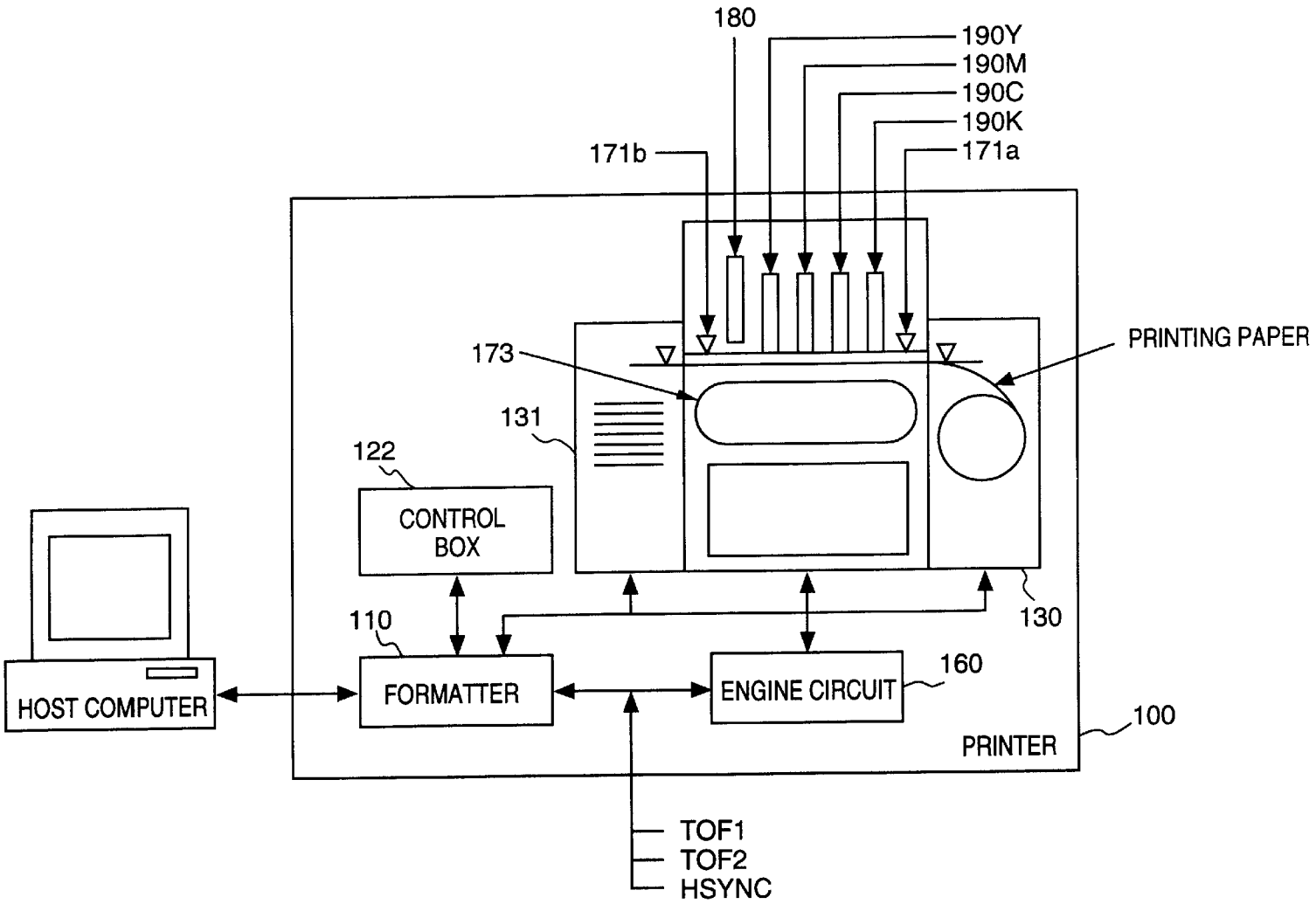
FIG. 2 is a sectional side view showing the schematic arrangement of the printer in FIG. 1.

FIG. 2 is a sectional side view showing the schematic arrangement of a printer 100 described above with reference to FIG. 1. FIG. 2 shows the printer 100 incorporating the control box 122, a printing paper supply unit 130 using roll paper as printing paper, and a printing paper discharge unit 131 having a cutter for cutting the roll paper after a print operation. The engine 150 is divided into these two parts 160 and 180 for easy implementation upon mounting on the printer, as shown in FIG. 2.

Reference numeral 190Y denotes a full-line printhead (Y head) for performing printing by using yellow (Y) ink; 190M, a full-line printhead (M head) for performing printing by using magenta (M) ink; 190C, a full-line printhead (C head) for performing printing by using cyan (C) ink; and 190K, a full-line printhead (K head) for performing printing by using black (K) ink. These printheads are arranged along the convey direction of printing paper.

Reference numeral 171*a* denotes a sensor for detecting the leading portion of the printing paper from black lines printed on the roll paper at predetermined equal intervals and generating a signal (TOF1); 171*b*, a sensor for detecting the leading portion of the printing paper from a black line printed on the roll paper after a print operation, and generating another signal (TOF2); and 173, a convey belt which is rotated/driven upon rotation of the convey motor 172. When the convey belt 173 is moved, the printing paper (recording medium) placed on the convey belt 173 is conveyed.

Figure 3:
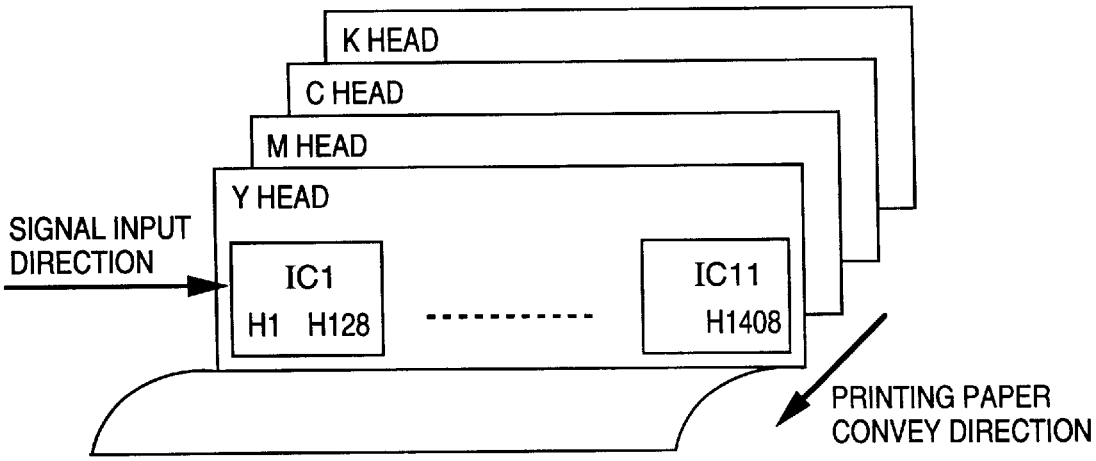
FIG. 3 is a view for explaining the printhead arrangement of the printer in FIG. 1.

FIG. 3 shows the printhead arrangement of the print unit of the printer of this embodiment.

The printhead 190 of this embodiment is constituted by four line heads, i.e., the K head for discharging black ink, the C head for discharging cyan ink, the M head for discharging a magenta ink, and the Y head for discharging yellow ink.

As shown in FIGS. 2 and 3, the printing paper is conveyed from the K head (190K) side and sequentially passes below the C head (190C), the M head (190M), and the Y head (190Y). When the printing paper passes below these heads, print data corresponding to the head portions of the respective colors are transferred to the heads, and the nozzle heaters in the heads are energized in accordance with the print data. With this operation, the inks are discharged from the corresponding nozzles to execute a print operation.

Figure 4:
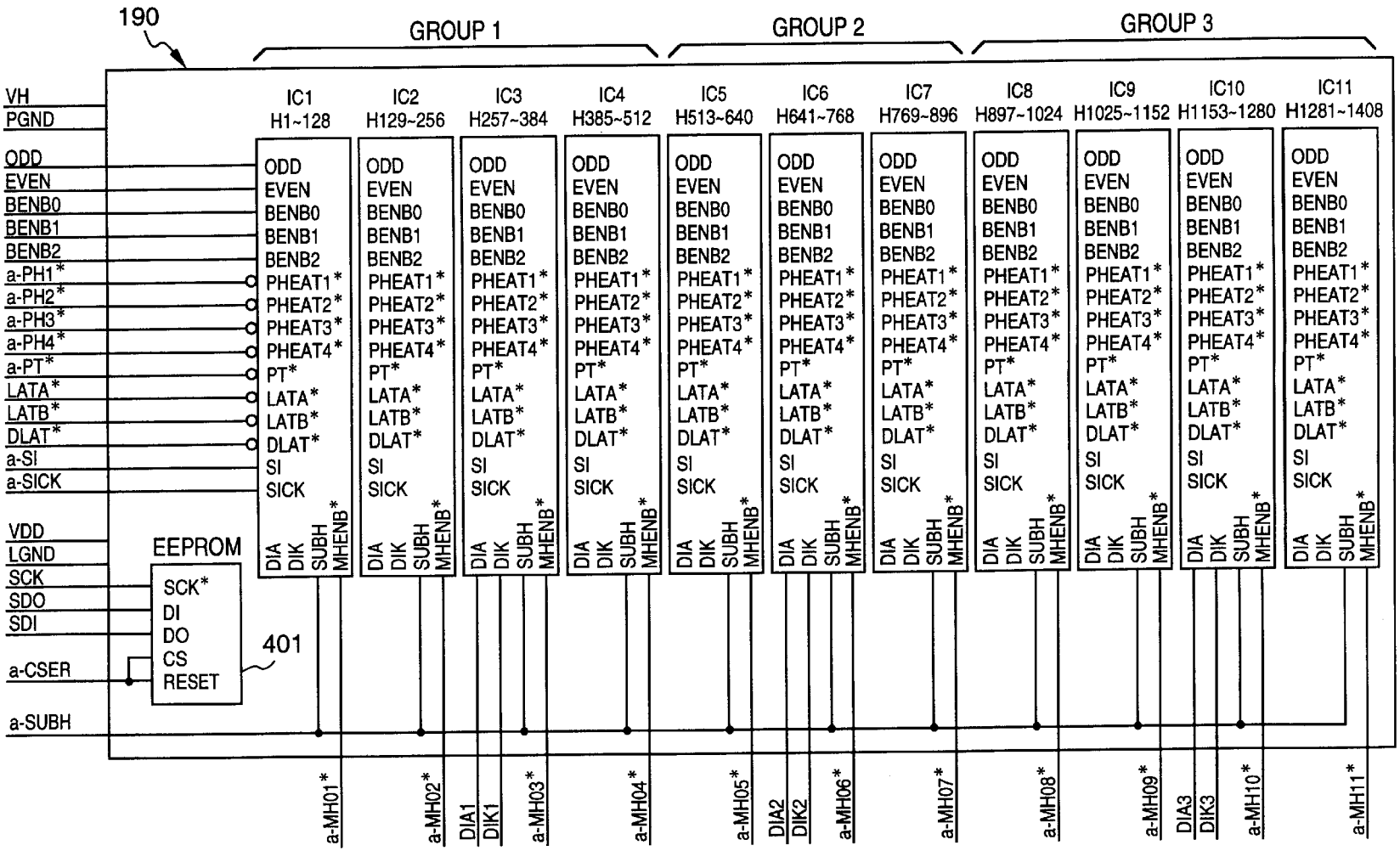
FIG. 4 is a view showing the arrangement of a printhead corresponding to one color.

FIG. 4 shows the arrangement of a printhead of the printer of this embodiment. As shown in FIG. 3 as well, each printhead includes ICs 1 to 11 each having 128 nozzles.

Figure 5:
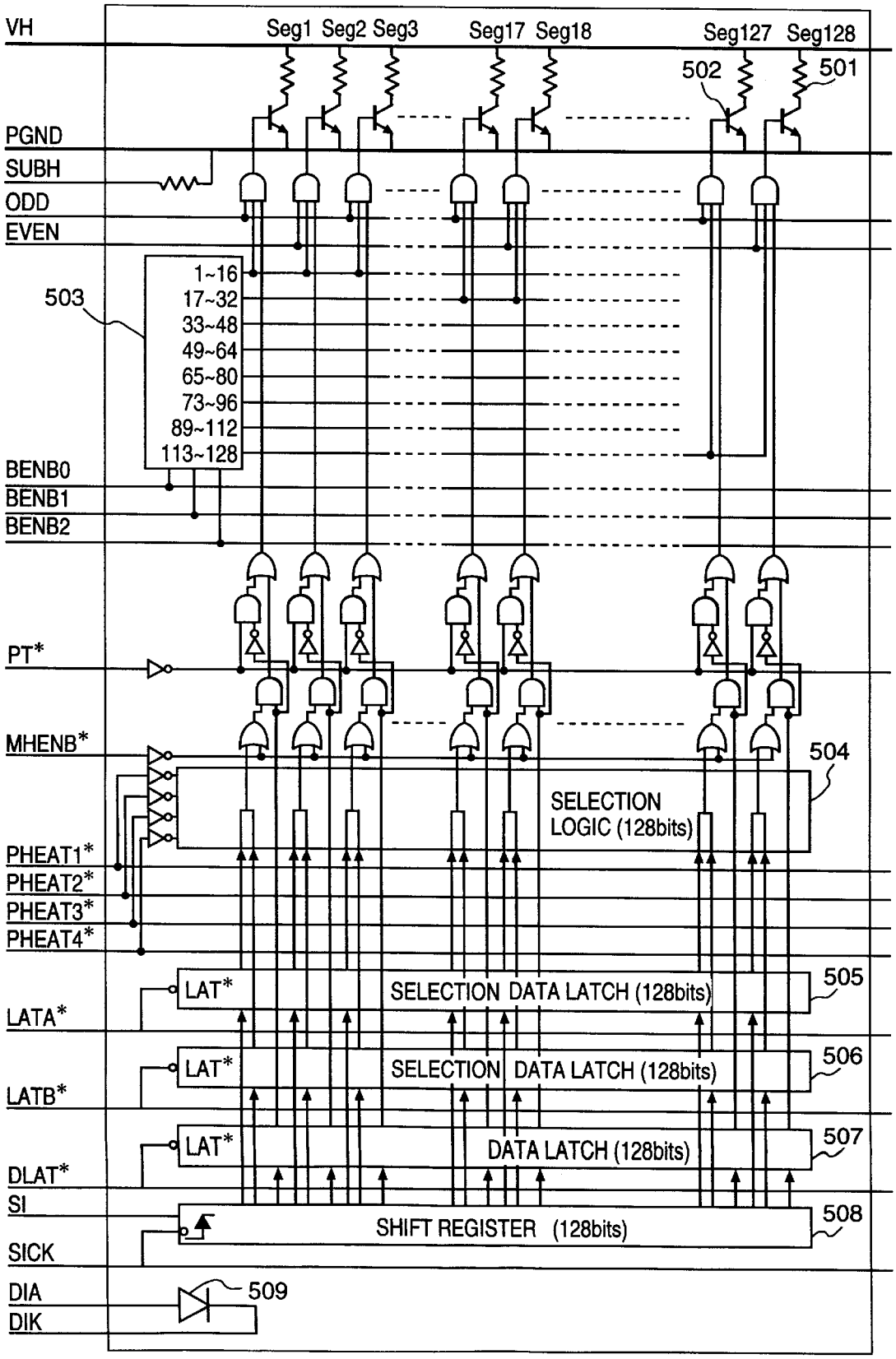
FIG. 5 is a circuit diagram showing the arrangement of a head IC of the printhead.

FIG. 5 shows the arrangement of an IC (head substrate) of a printhead of this embodiment. The ICs 1 to 11 have the same arrangement. In the following description, "*" indicates a low true signal which is true at low level.

Referring to FIG. 5, reference symbol VH denotes a power supply voltage applied to a heater 501; and PGND, GND (ground) of a heater power supply. Reference numeral 502 denotes a transistor for driving the heater 501. Reference symbol ODD denotes a signal for designating sending an electricity to the odd-numbered heaters 501; and EVEN, a signal for designating sending an electricity to the even-numbered heaters 501. Reference numeral 503 denotes a 3 to 8 decoder. In this embodiment, the 128 heaters 501 are grouped into eight blocks (16 nozzles per block), and the 3 to 8 decoder 503 selects a block of heaters 501 to be driven in accordance with a block selection signal (BENB0 to BENB2). Reference symbol SUBH denotes a sub-heat signal; PT*, a signal for heating nozzles when no print operation is performed; MHENB*, a heat pulse signal for sending an electricity to nozzles when a print operation is actually performed; and PHEAT1* to PHEAT4*, pre-heat pulses, which are selected by a selection logic 504 in accordance with selection data set in selection data latches 505 and 506 (to be described later). The heaters 501 are pre-heated by the selected pulse signals.

In this case, the signal PT* is a signal for adjusting the internal temperature of a printhead. This signal is used to apply pulses to the printhead so as to raise its temperature when the operating or environmental temperature of the printhead is low and no print operation is performed. The signals PHEAT1* to PHEAT4* are used as pre-heat pulses when double pulse print control is performed during a normal print operation.

Reference numeral 508 denotes a shift register for receiving selection data for selecting the pre-heat pulses (PHEAT1* to PHEAT4*) as serial data (SI) in synchronism with a clock (SICK) and holding 128 -bit data. The print data held in this manner is latched by a data latch 507 in response to a signal DLAT*. The selection data is latched by the selection data latch 505 in response to a signal LATA*, and is also latched by the selection data latch 506 in response to a latch signal LATB*. Reference symbol DIA denotes an input signal to a sensor 509; and DIK, an output signal from the sensor 509.

Figure 6:
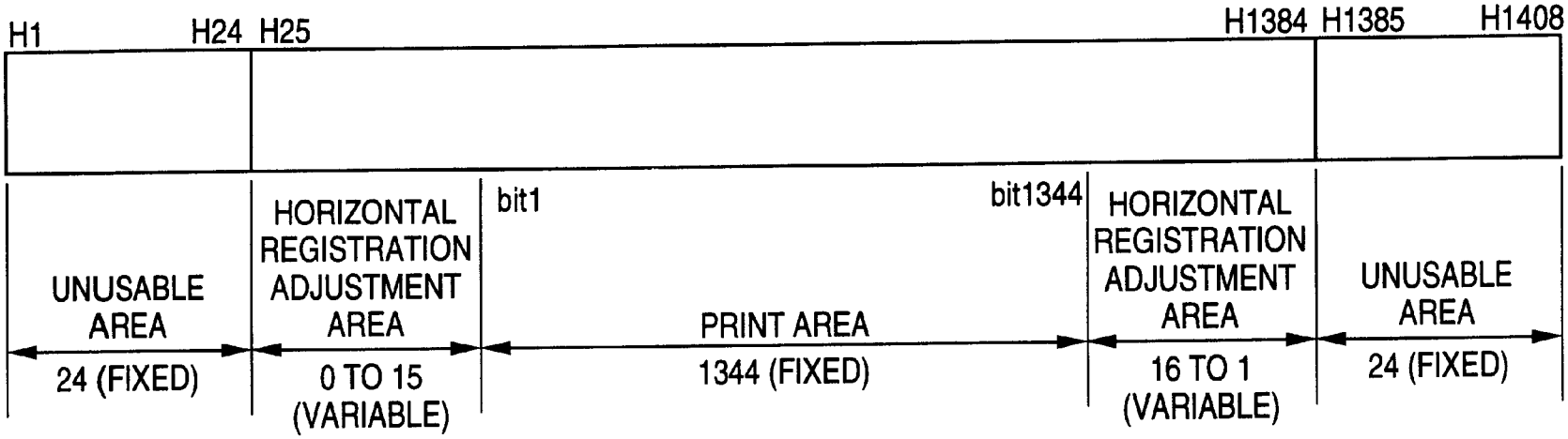
FIG. 6 is a view showing the arrangement of the nozzle heaters of the printhead.

FIG. 6 shows the heater arrangement of the printhead of this embodiment.

The total number of nozzles of the printhead of this embodiment is 128×11=1,408. In the manufacturing process for a printhead, unusable areas may be formed on the right and left portions of the printhead. For this reason, if, for example, these areas respectively include 24 nozzles near each of the right and left end portions of the printhead, a total of 1,360 nozzles are usable nozzles, which correspond to the number obtained by subtracting "48" from the total number of nozzles.

As described above, the color printer of this embodiment includes the four heads corresponding to the four colors, i.e., K, C, M, and Y, and the nozzle positions (the positions of dots to be printed) of the heads of the respective colors must be accurately aligned to be superposed. If this positioning is not accurate, proper color representation cannot be attained, and a high-image quality color print operation cannot be performed. Since such a positioning operation is very minute adjustment (on the micron ($\mu$m) order), this operation cannot be mechanically performed. For this reason, horizontal registration adjustment nozzles for positioning the printheads of the respective colors are used. The print positions of the printheads of the respective colors are adjusted depending on how many of the adjustment nozzles are used for a print operation. If the number of nozzles for horizontal registration adjustment is 16, the number of nozzles which can be used for a print operation is 1,344.

FIGS. 7A to 7B comprise a timing chart showing a print sequence in the printer of this embodiment. Note that "a" of a signal name "a-xxx" in FIG. 7 indicates color signals of K, C, M, and Y, and the respective colors correspond to these signal lines. In the following description, similar signal names will be used.

Print data is sent, as a signal SI, to the printhead in synchronism with a SICK (serial clock) signal, and is stored in the shift register 508. When the signal DLAT* is made active after the data is transferred by one line, the data is temporarily stored in the data latches 507 in the ICs 1 to 11. Thereafter, heater blocks to be heated are sequentially selected in accordance with the signal ODD (odd-numbered nozzle selection signal), the signal EVEN (even-numbered nozzle selection signal), the signal BENB0 (block 0 selection signal), the signal BENB1 (block 1 selection signal), and the signal BENB2 (block 2 selection signal). Signals a-PH1* to a-PH4* and a-MH1* to a-MH11 are then made active to send an electricity to the heaters 501 of the respective ICs. With this operation, an ink is discharged from the corresponding nozzles to perform a print operation.

Note that print data for the next line is transferred while the heaters for the currently printed line are energized. The signal DLAT* for the next line must be made active after the lapse of one of the heat time of the heaters for the currently printed line or the data transfer time, whichever is longer. This is because, if the signal DLAT* for the next line is made active in the heat time of the heaters for the currently printed line, print data set after the signal DLAT is made active becomes print data for the next line.

In general, the print speed is determined mainly by the basic performance of a printhead. In this case, since the heat time of the heaters is longer than the data transfer time, the signal DLAT* becomes active in a print operation after a normal heater energizing operation.

Referring to FIG. 7, reference numeral 701 denotes the energization timing of the 1st heater, the 17th heater, the 33rd heater, . . . , the 1,393rd heater. At the timing 701, since data (DATA) is "0", only the heat pulses based on a signal a-PT* are applied. Reference numeral 702 denotes the heat timing of the 2nd heater, the 18th heater, the 34th heater, . . . , the 1,394th heater. At the timing 702, since data is "1", main heat pulses of a width T3 are applied after a pre-heat period of a width T1 and a quiescent period of a width T2. Reference numeral 703 denotes the heat timing of the 3rd heater, the 19th heater, the 35th heater, . . . , the 1,395 heater. Similar to the timing 701, at the timing 703, since data is "0", only the heat pulses based on the signal a-PT* are applied.

As shown in FIG. 4, the printhead incorporates an EEPROM 401 for storing information about the nozzles. For example, the contents stored in the EEPROM 401 include pre-pulse data, pre-pulse selection data, temperature adjustment pulse data, head rank data, and other ID data.

[Description of Engine Circuit 180 and Gate Array (GAE) 181]

Figure 8A:
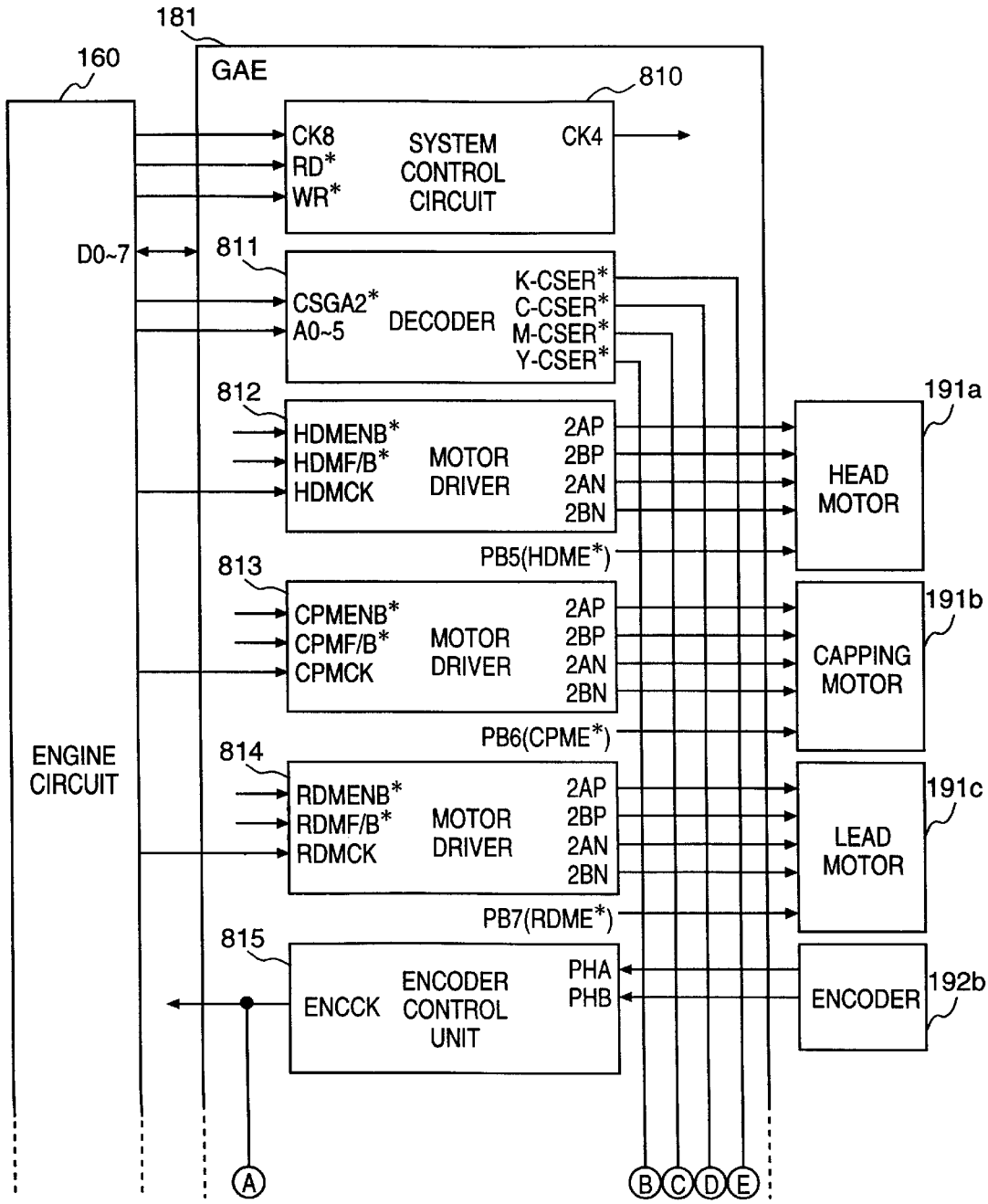
FIGS. 8A and 8B are block diagrams showing the arrangements of a GAE 181 in an engine circuit 180.
Figure 8B:
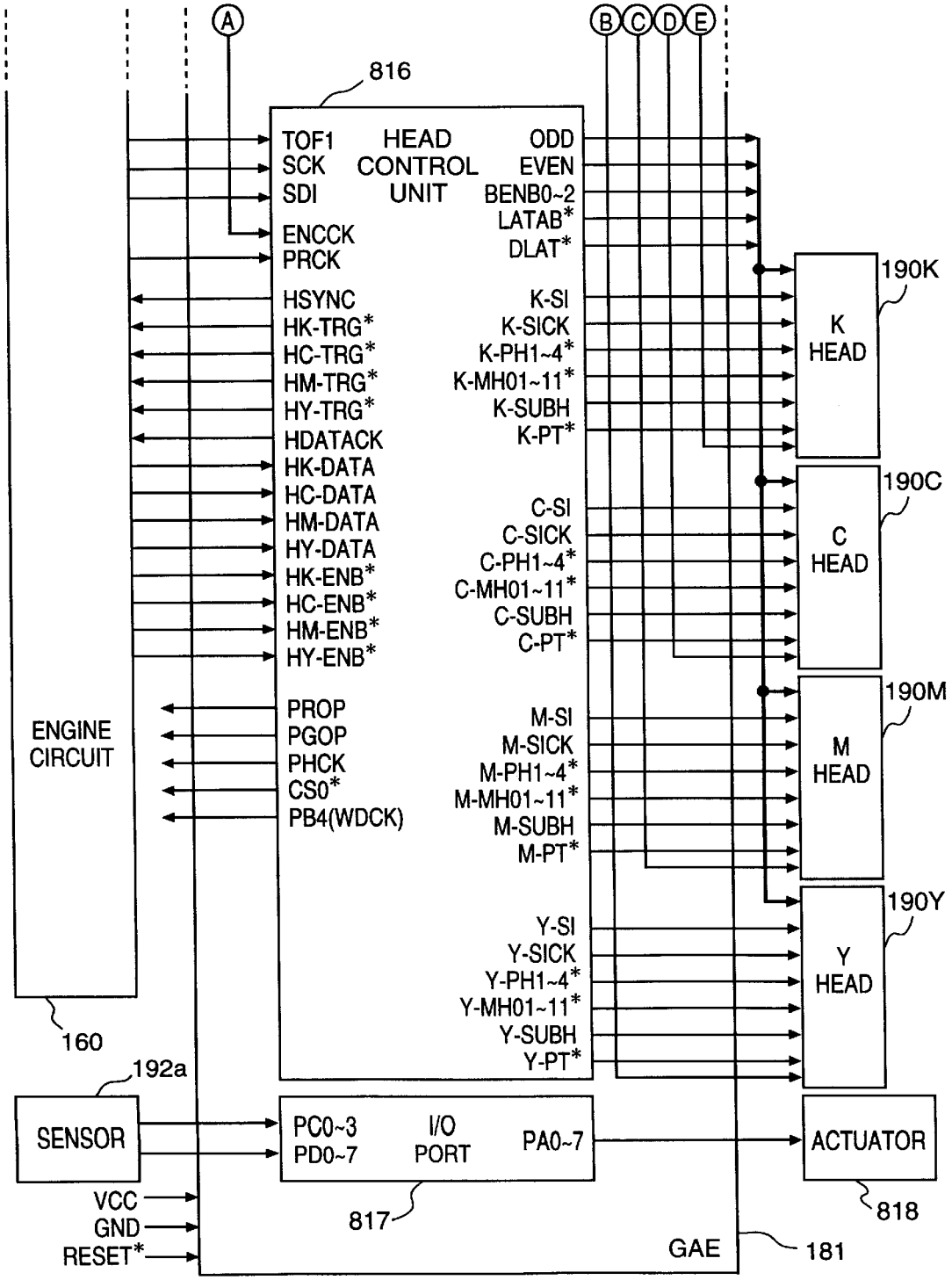

FIGS. 8A and 8B are block diagrams showing the arrangements of the gate array (GAE) 181 in the engine circuit 180.

The GAE 181 has a function of controlling the rotations of motors 191*a* to 191*c* required for the engine circuit 180, a function of controlling an encoder 192*b* which operates in synchronism with the movement of printing paper, the above printhead control function, a port control function, and the like. Reference numeral 810 denotes a system control circuit; 811, a decoder; 812 to 814, motor drivers for rotating/driving the corresponding motors; 191*a,* the head motor for vertically moving the printhead 190 to perform a recovery operation therefor; 191*b,* the capping motor for moving a cap to cap the printhead 190; and 191*c,* the lead motor. The encoder 192*b* is brought into contact with printing paper as a recording medium and generates a signal upon movement of the paper. The signal from the encoder 192*b* is input to an encoder control unit 815 to generate a signal ENCCK, which is output to a head control unit 816. Reference numeral 192*a* denotes a sensor unit, which includes sensors for detecting the position of the printhead in the vertical direction, the position of the cap, and the like. Input signals from these sensors are input through an I/O port 817 and output to an actuator 818. Reference numeral 816 denotes a head control unit for controlling data to be output to the printheads of the respective colors, performing driving control of the printheads, and the like. The operation of the head control unit 816 will be mainly described below.

Figure 9B:
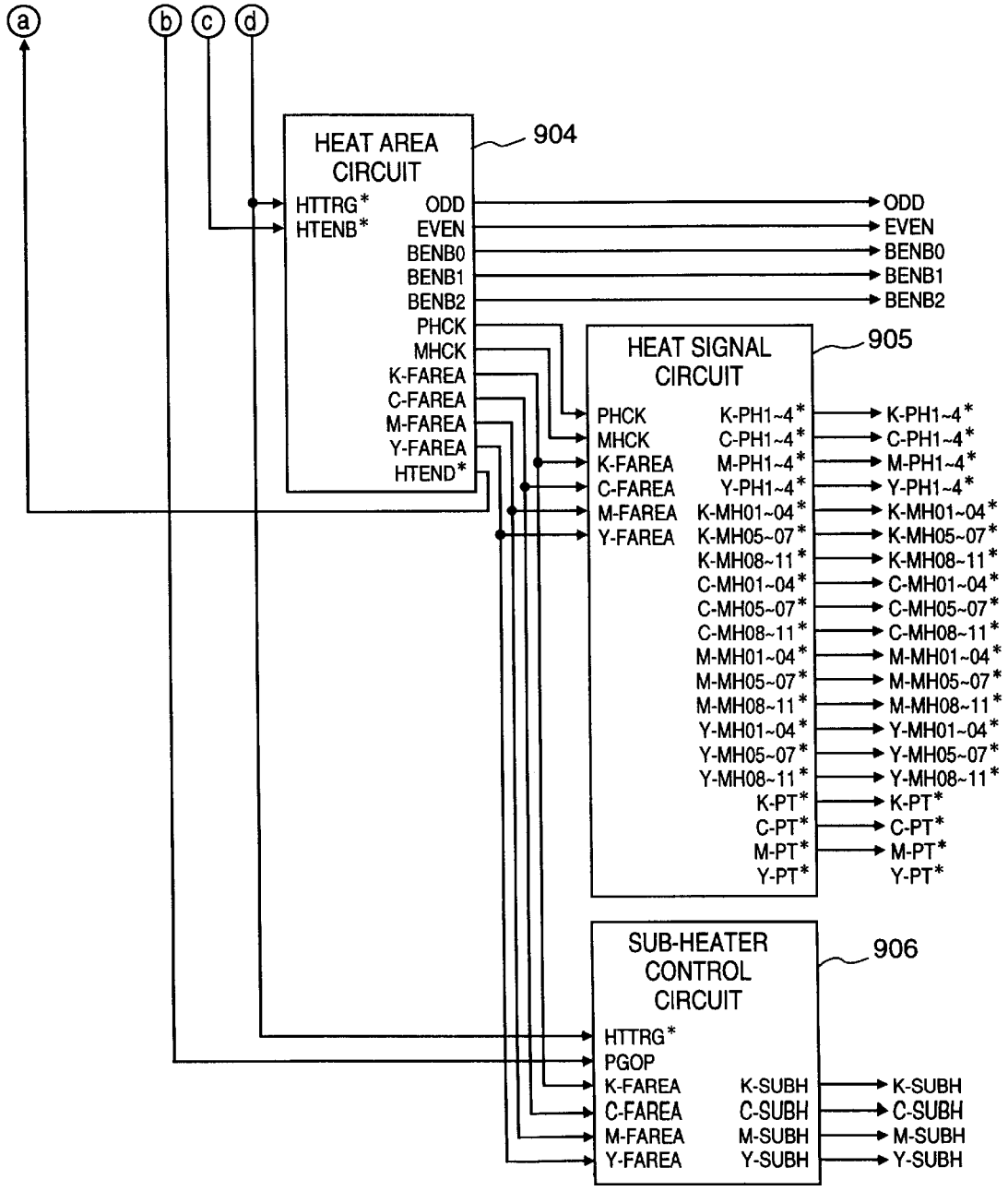
Figure 10:
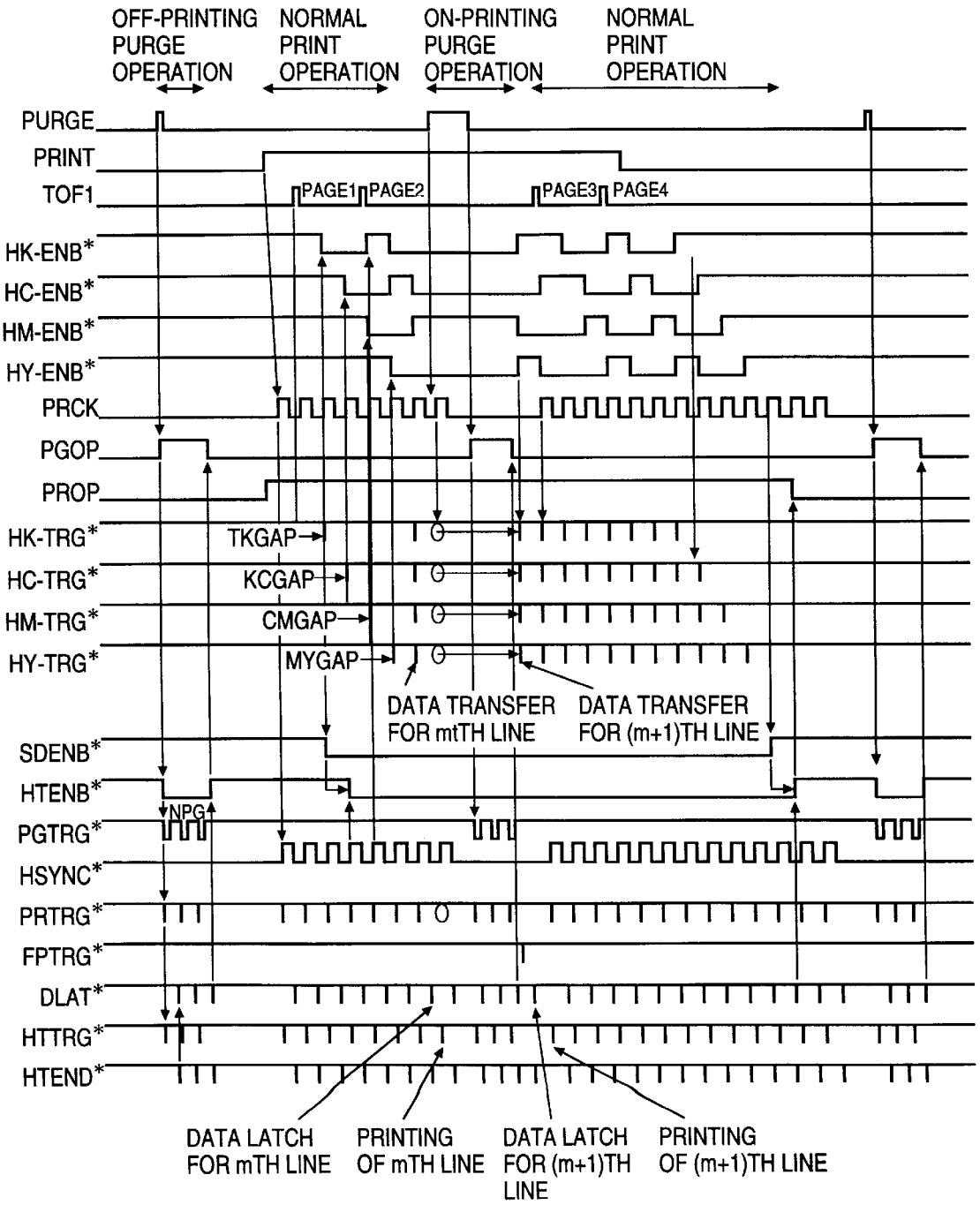
FIG. 10 is a timing chart showing a print operation timing set by the head control unit.

FIGS. 9A and 9B are circuit diagrams of the head control unit 816 in this embodiment. FIG. 10 is a timing chart showing a printing operation controlled by the head control unit 816.

The head control unit 816 includes a horizontal synchronization circuit 900, a vertical synchronization circuit 901, a transfer area circuit 902, a transfer data circuit 903, a heat area circuit 904, a heat signal circuit 905, and a sub-heater control circuit 906. The respective circuits will be sequentially described below.

(a) Horizontal Synchronization Circuit 900

The horizontal synchronization circuit 900 is a circuit for generating a signal HSYNC serving as a reference signal for the printer of this embodiment. This printer uses a stepping motor as the convey motor 172. For example, printing paper is conveyed by 70.5 $\mu$m (one-dot distance: 1/360 in.) per driving clock for the convey motor 172. The signal HSYNC signal is generated on the basis of a signal PRCK as this clock signal.

In some case, the friction coefficient between printing paper and the convey belt 173 is small, and the rotation distance of the convey motor 172 does not coincide with the moving distance of the printing paper. For this reason, the printer incorporates the encoder 192*b* capable of directly detecting the moving amount of the printing paper so that the signal HSYNC can be generated on the basis of a clock output signal (ENCCK) output from the encoder control unit 815 in accordance with a signal from the encoder 192*b*.

The horizontal synchronization circuit 900 generates the above signal DLAT* on the basis of a signal HTEND* as a heat end signal for nozzle heaters. A signal HSTRG* is a trigger signal based on the signal HSYNC*. A signal PGTRG* is a trigger signal for a purge operation to be described later.

(b) Vertical Synchronization Circuit 901

The vertical synchronization circuit 901 generates print data request signals HK-TRG*, HC-TRG*, HM-TRG*, and HY-TRG* for the respective colors on the basis of the signal HSYNC. The signal HK-TRG* is output after lines (TKGAP in FIG. 10) corresponding to ((the distance from the TOF1 sensor 171*a* to the black head 190K)−1) are counted with the signal HSYNC with reference to a signal TOF1 detected when printing paper is conveyed. If, for example, the distance from the TOF1 sensor 171*a* to the black head 190K is 10 mm, a signal HK-TRG* is output after the signal HSYNCs corresponding to 141 clocks (10×1,000/70.5−1) are counted. That is, the signal HK-TRG* signal is output at the timing of transferring print data for the black head 190K. The signal HC-TRG* is output after lines (KCGAP in FIG. 10) corresponding to ((the distance between the black head 190K and the cyan head 190C)−1) are counted with the signal HSYNC. Similarly, the signal HM-TRG is output after lines (CMGAP in FIG. 10) corresponding to ((the distance between the cyan head 190C and the magenta head 190M)−1) are counted with the signal HSYNC. The signal HY-TRG is output after lines (MYGAP in FIG. 10) corresponding to ((the distance between the magenta head 190M and the yellow head 190Y)−1) are counted with the signal HSYNC. With these operations, data can be transferred to the head of each color at the timing one line ahead of the position of the printhead.

The engine circuit 160 returns a signal HK-ENB* on the basis of the signal HK-TRG*. The signal HK-ENB* is used to count lines to be printed, and corresponds to the page length. While the signal HK-ENB* is active, the signal HK-TRG* is output in synchronism with the signal HSYNC* to transfer data in units of lines. The same operation is performed with respect to signals HC-ENB*, HM-ENB*, and HY-ENB*.

With this data transfer method, print data can be transferred from the formatter 110 to the engine 150 without incorporating any print buffer in the engine 150 so that a great reduction in the cost of the engine 150 can be attained.

The signal PRTRG* is the logical sum of a trigger signal HSTRG* output in synchronism with the signal HSYNC and the signal PGTRG*. This will be described later.

The vertical synchronization circuit 901 also generates a signal HTTRG* for starting to send an electricity to nozzle heaters.

(c) Vertical Registration Adjustment

As described above, in the color printer, the print dot positions for the respective colors must accurately coincide with each other. This is because dots of colors other than cyan, magenta, and yellow are printed while being superposed on dots of other colors. For example, a blue dot is printed by superposing cyan and magenta dots; a red dot, by superposing magenta and yellow dots; and a green dot, by superposing yellow and cyan dots. However, since the print dot size is as small as 70.5 μm, such a precision cannot be mechanically attained. For this reason, a registration adjustment function is required. In this printer, the CPU-E 161 sets the counter value for generating the above print data request signal in the GAE 181. Even if, therefore, the mechanical precision is low, the print dot positions can be accurately aligned by changing the counter value.

(d) Transfer Area Circuit 902

Figure 11:
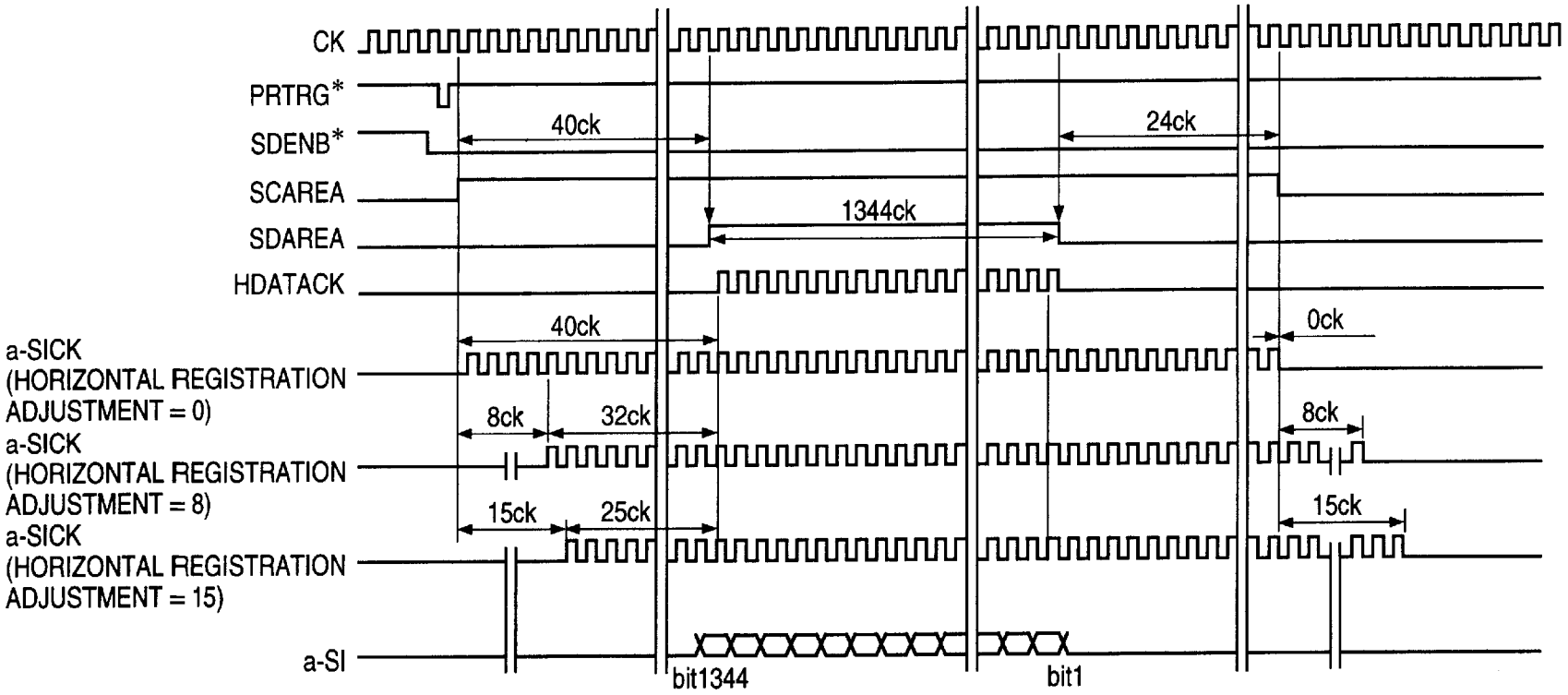
FIG. 11 is a timing chart showing an operation sequence in a transfer area circuit 902 and a transfer data circuit 903.

FIG. 11 is a timing chart showing a sequence of operations of the transfer area circuit 902 and the transfer data circuit 903 in this embodiment.

The transfer area circuit 902 generates a signal HDATACK as a data transfer clock signal for the engine circuit 160, a signal SCAREA for generating the output timing of the SICK signal for the printhead 190, and a signal SDAREA for generating an effective area timing for each color data.

As described above, the printhead 190 has nozzle areas which cannot be used for a print operation. For these areas, only the SICK signal must be transferred without transferring actual data with the SI signal (i.e., transferring "0" data instead). In addition, only one signal HDATACK is transferred to the engine circuit 160. For this reason, in order to perform horizontal registration adjustment in the GAE 181 for each color, the SICK signal corresponding to the total number of nozzles may be output after the SICK signal is delayed by a time corresponding to a registration adjustment area with respect to the signal SCAREA, and the signal HDATACK corresponding to the number of print dots may be output after the signal HDATACK is delayed by a time corresponding to (an area which cannot be used for a print operation (24 nozzles))+(a horizontal registration adjustment area (16 nozzles)=) 40 clocks with respect to the signal SCAREA.

(e) Horizontal Registration Adjustment

As described above, since an increase in mechanical position precision is limited, the print positions in the horizontal direction must also be electrically adjusted. This adjustment method can be realized by shifting the signal SCAREA for each color and adjusting the output timing of the SICK signal for each color. More specifically, the CPU-E 161 adjusts the value of the horizontal registration adjustment register of the GAE 181 between "0" and "15" to change the number of clocks between the signal HDATACK and the SICK signal, thereby changing the positions of print nozzles in the horizontal direction. Assume that the horizontal registration adjustment of the black (K) head is set to "8", and the horizontal registration adjustment of the cyan (C) head is set to "15". In this case, eight nozzles of the print nozzles of the black head 190K on the right side are set as unused nozzles for horizontal registration adjustment, and 15 nozzles of the print nozzles of the cyan head 190C on the right side are set as unused nozzles for horizontal registration adjustment. In this state, a print operation is performed.

(f) Heat Area Circuit 904

The heat area circuit 904 generates a signal PHCK serving as a reference signal for time-divisionally sending an electricity to nozzle heaters, the time-division signals ODD, EVEN, BENB0, BENB1, and BENB2 from the signal PHCK, and signals K-FAREA, C-FAREA, M-FAREA, and Y-FAREA indicating the timings at which an electricity is time-divisionally sent to the nozzles of the respective colors. Note that the arrangement of the heat area circuit 904 will be described in detail later.

(g) Heat Signal Circuit 905

The heat signal circuit 905 generates the signals PHEAT1* to PHEAT4* and the signals MH1* to MH11* required to perform a print operation based on double pulse control, and the signal PT* as a heat pulse for internal temperature adjustment for each color. Referring to FIG. 7, "a-PT*" is a general term corresponding to the printheads 190K, 190C, 190M, and 190Y of the inks of the respective colors. The signals PHEAT1* to PHEAT4* are used as control signals for applying pre-pulses during a normal print operation.

A circuit, in the heat signal circuit 905, which generates pre-pulses will be described in detail later.

(h) Sub-heater Control Circuit 906

The printhead 190 includes sub-heaters for heating/controlling the head independently of the nozzle heaters. The sub-heater control circuit 906 controls the sub-heaters.

(i) Recovery Operation

The ink-jet printer requires an operation sequence called a recovery operation to prevent clogging of nozzles in the printhead. This operation is required to eliminate factors which make the ink discharge operation unstable. For example, an ink may coagulate in nozzles, or dust and the like may adhere to the orifices of nozzles. More specifically, the ink in the printhead is pressurized and circulated, or the ink is forcibly discharged from all the nozzles.

Such an operation is irrelevant to the normal operation of the printer and must be performed independently of the formatter 110. Therefore, the recovery operation must be performed by only the engine 150. The recovery operation is basically performed during a period other than that of a print operation. If, however, the print time is long or high-density print operations are consecutively performed, a recovery operation must be performed even during the print operation. For this reason, recovery sequences are based on two operation timings, i.e., an off-printing purge operation timing and an on-printing purge operation timing, each of which requires control (see FIG. 10).

(j) Off-printing Purge Operation

The recovery operation of the printhead is an operation of discharging an ink from all the nozzles. No reference will be made to other operations, e.g., forcibly circulating an ink and wiping the discharge surfaces of the nozzles. An off-printing purge operation sequence will be described with reference to FIG. 10.

(1) The CPU-E 161 sets "1" first in the PURGE register of the GAE 181, and then sets "0" therein.

(2) The GAE 181 sets a signal PGOP indicating the execution of a purge operation to "1", and causes the horizontal synchronization circuit 900 to output the signal PGTRG*.

(3) The vertical synchronization circuit 901 outputs the signal HTTRG* on the basis of the signal PGTRG*. At this time, the signal PRTRG* is not output because no print data is requested.

(4) The transfer data circuit 903 fixes the signal SI as the print data of each color to high level and transfers the SICK signal.

The detailed arrangement and operation of the transfer data circuit 903 will be described later.

(5) The heat area circuit 904 and the heat signal circuit 905 generate normal double pulses from the signal HTTRG* to discharge an ink from printheads. When this ink discharging operation is completed, the signal HTEND* becomes active.

(6) The horizontal synchronization circuit 900 makes the signal DLAT* active in accordance with the signal HTEND*. With this operation, all the data in the printhead are set to the ON ("1") state, and afterward ink is discharged from all of orifices in the printhead (hereinafter this ink discharge operation is referred to as "a full-dot discharging operation").

(7) The vertical synchronization circuit 901 counts the signal DLAT*, and the CPU-E 161 performs a full-dot discharging operation the number of times set in the NPG register of the GAE 181.

(8) When the operation is completed, the GAE 181 sets the signal PGOP to "0", and the CPU-E 161 reads this signal and detects the end of the purge operation.

With the above operations, the off-printing purge operation is performed.

(k) On-printing Purge Operation

As described above, the transfer timing of print data differs from the nozzle heat timing of the printhead for the print data by one line. If, therefore, the above off-printing purge operation is performed during a print operation, print data for one line is lost, and printing is performed on the printing paper with all inks throughout the one line. For this reason, in the on-printing purge operation, the data transfer request signal to the formatter 110 is disabled at the timing of one line before the execution of the purge operation, and the data transfer request signal is output at the timing at which the on-printing purge operation is ended. This operation can be realized by controlling the timing at which the CPU-E 161 sets "1" in the PURGE register of the GAE 181 in the following manner.

(1) The CPU-E 161 detects the timing of the execution of an on-printing purge operation through some means.

(2) The CPU-E 161 sets "1" in the PURGE register of the GAE 181.

(3) The vertical synchronization circuit 901 of the GAE 181 masks the signal PRTRG* as the print data request signal to inhibit its output.

(4) The CPU-E 161 sends a clock to the convey motor 172 to convey the printing paper by one dot.

(5) Although the GAE 181 generates the signal HSYNC, the signal PRTRG* is not output. For this reason, data transfer from the formatter 110 is not performed. Since the signal HTTRG* is output, data for the m-th line is printed.

(6) The CPU-E 161 sets "0" in the PURGE register of the GAE 181.

(7) The vertical synchronization circuit 901 of the GAE 181 cancels the masked state of the signal PRTRG* to output it afterward.

(8) The GAE 181 performs the same operation as the off-printing purge operation.

(9) When the off-printing purge operation is completed, the vertical synchronization circuit 901 of the GAE 181 outputs a signal PPTRG*.

(10) The transfer area circuit 902 and the transfer data circuit 903 of the GAE 181 transfer data for the (m+1)th line.

(11) After the signal SCAREA becomes inactive by the signal PPTRG*, the horizontal synchronization circuit 900 of the GAE 181 outputs the signal DLAT*.

(12) The normal print operation is resumed.

With the above operations, not only the on-printing purge operation is properly performed, but also a proper print operation is performed.

[Detailed Description of Double Pulse Print Control (pre-heat pulse control in particular)]

As is well-known in applying a voltage to each nozzle heater, the ink discharge amount can be stabilized by using a method of applying a short pulse (pre-pulse) first, and then applying a long pulse (main pulse) rather than by using a method of applying one longer pulse in one operation. The former method is called a double pulse print control method. Portions T1 and T3 in FIG. 7 respectively correspond to the pre-pulse and the main pulse.

In this embodiment, four types of pre-pulse signals are used for the four printheads 190K, 190C, 190M, and 190Y for discharging inks of the respective colors. The reason for this will be described below.

Since the ink discharge amount per nozzle of the printheads varies depending on the manufacturing processes, density unevenness occurs on a printed image in units of nozzles. In order to prevent such density unevenness, the width of the pre-heat pulse, therefore, must be changed in units of nozzles. More specifically, a long pre-heat pulse is applied to a nozzle with a small discharge amount, while a short pre-heat pulse is applied to a nozzle with a large discharge amount. For this reason, a plurality of pre-pulse signals are required.

The four types of pre-pulses are set as follows. The CPU-E 161 reads out pre-pulse data recorded on the EEPROM 401 in each printhead and sets the data in the GAE 181. The GAE 181 then generates the signals a-PH1* to a-PH4* at a proper timing.

The pulse width setting operation in units of nozzles is determined by pre-pulse selection data. There are four types of pre-pulse data, and 2-bit data may be used to select pre-pulse data through a selection circuit (not shown). More specifically, when the value of the 2-bit data is "00", the signal PHEAT1* is applied to the corresponding nozzle heater. Similarly, the signal PHEAT2* is applied when the data is "01"; the signal PHEAT3*, when the data is "10"; and the signal PHEAT4*, when the data is "11".

Figure 12:
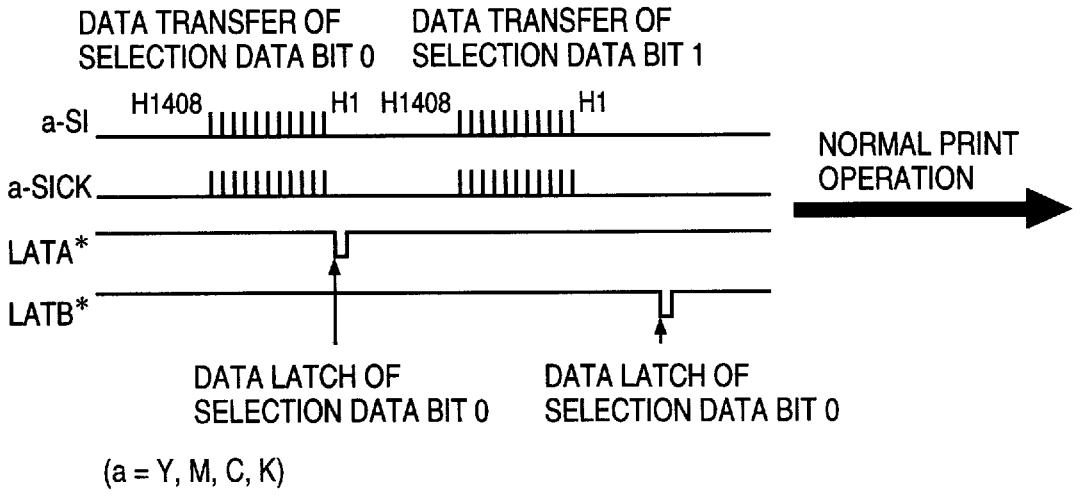
FIG. 12 is a timing chart showing a pre-pulse setting sequence.

This setting of the selection signals is executed in accordance with the pre-pulse setting sequence in FIG. 12. For the sake of descriptive convenience, the symbol "a-" of each signal name in FIG. 12 is used as a general term, although different signals are used for the printheads of the respective inks.

The CPU-E 161 reads out the LSB (bit 0) of 2-bit pre-pulse selection data from the EEPROM 401 of each printhead when the power supply of the printer is turned on. The CPU-E 161 then sets this data in the GAE 181. The GAE 181 transfers the selection data to the printhead with the signal SI in synchronism with the SICK signal. In this manner, the selection data associated with a total of 1,408 nozzles of the printhead are stored in the shift registers 508 of all the ICs of the printhead. When this transfer is completed, the signal LATA* becomes active (low active). With this operation, the selection data from the shift registers 508 are latched by the selection data latches 505.

Subsequently, the CPU-E 161 reads out the MSB (bit 1) of the 2-bit pulse selection data from the EEPROM 401 in the printhead, and sets the data in the GAE 181 similar to the setting of bit 0. The GAE 181 outputs the selection data to the printhead with the signal SI in synchronism with the SICK signal. In this manner, the selection data associated with a total of 1,408 nozzles of the printhead are stored in the shift registers 508 of all the ICs. When this transfer operation is completed, the latch signal LATB* becomes active (low active). With this operation, the selection data from the shift registers 508 are latched by the selection data latches 506.

With the above operation, the 2-bit selection data associated with a total of 1,408 nozzles of the printhead are latched in the printhead. Thereafter, optimal pre-pulses for the respective nozzles are selected in accordance with the signals PHEAT1*, PHEAT2*, PHEAT3*, and PHEAT4*. With this operation, the ink discharge amounts from the respective nozzles are made uniform to prevent density unevenness.

Note that the main pulse is a pulse for actually causing ink to be discharged and is controlled in units of ICs.

The above pre-pulse data setting operation will be described next with reference to an actual circuit.

Figure 13:
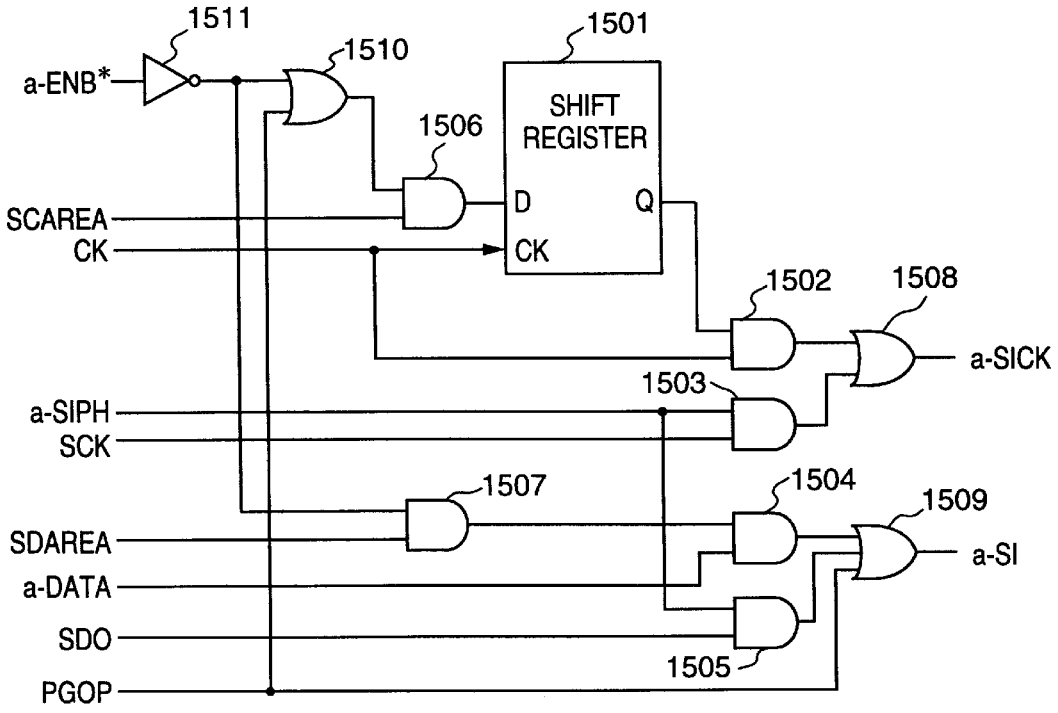
FIG. 13 is a block diagram showing the arrangement of the transfer data circuit.

FIG. 13 is a circuit diagram showing the detailed arrangement of a transfer data circuit. Since this circuit arrangement is common to print operations using four types of inks or the four printheads, FIG. 13 shows an arrangement for one printhead. For the sake of descriptive convenience, the symbol "a-" of each signal name in FIG. 13 is used as a general term, although different signals are used for the printheads of the respective inks. In practice, therefore, for example, a signal a-CSPH includes signals K-CSPH, C-CSPH, M-CSPH, and Y-CSPH according to the types of printheads.

Referring to FIG. 13, reference numeral 1501 denotes a shift register; 1502 to 1507, AND circuits; 1508 to 1510, OR circuits; and 1511, an inverter.

In a normal print operation, the transfer data circuit outputs a print data signal a-DATA transferred from the engine circuit 160 as a signal a-SI to the printhead. When the power supply of the printer is turned on, the CPU-E 161 reads out the above pre-pulse selection signals from the EEPROM 401 in the printhead.

First of all, the signal K-CSPH as a selection signal for the printhead 190K is made active. The GAE 181 then connects a signal SCK to a signal K-SICK, and connects a signal SDO to a signal K-SI in accordance with the signal K-CSPH. The CPU-E 161 transfers the LSB (bit 0) of the 2-bit pre-pulse selection signal as the signal SDO to the printhead 190K. When this transfer operation is completed, the signal C-CSPH* as a selection signal for the printhead 190C is made active, and the same setting operation as that for the printhead 190K is performed. The same applies to the printheads 190M and 190Y. Thereafter, the signal LATA* corresponding to the port function of the GAE 181 is made active.

Next, the MSB (bit 1) of the 2-bit pre-pulse selection signal is transferred, as the signal SDO, to the printhead 190K by making the signal K-CSPH* active. Thereafter, the signal C-CSPH* is made active and transferred to the printhead 190C. Likewise, the signals are sequentially transferred to the printheads 190M and 190Y, and the latch signal LATB* becomes active. With this operation, data setting in the selection logic 504 of the printhead 190K is completed.

With the above operation, the signals PHEAT1* to PHEAT4* in the printheads 190K, 190C, 190M, and 190Y can be selected in units of nozzle heaters.

These pre-pulses and main pulses are required for each ink color (or each printhead). For this reason, the signals PHEAT1* to PHEAT4* connected to the printhead 190K are respectively signals K-PH1* to K-PH4*; and the signals MH1* to MH11*, signals K-MH1* to K-MH11*. Similarly, the signals PHEAT1* to PHEAT4* connected to the printhead 190C are respectively signals C-PH1* to C-PH4*; and the signals MH1* to MH11*, signals C-MH1* to C-MH11*. The signals PHEAT1* to PHEAT4* connected to the printhead 190M are respectively signals M-PH1* to M-PH4*; and the signals MH1* to MH11*, signals M-MH1* to M-MH11*. The signals PHEAT1* to PHEAT4* connected to the printhead 190Y are respectively signals Y-PH1* to Y-PH4*; and the signals MH1* to MH11*, signals Y-MH1* to Y-MH11*.

Figure 14:
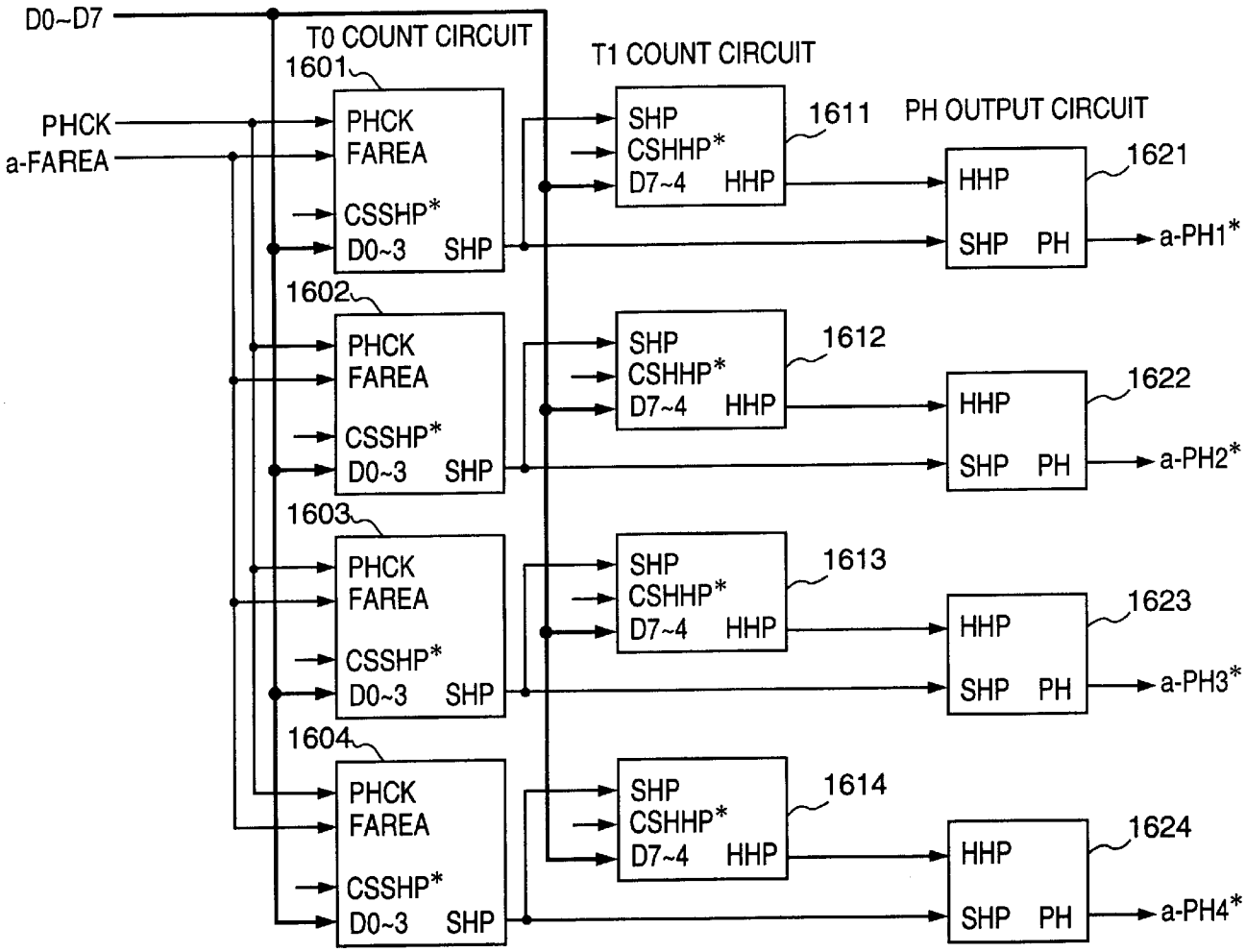
FIG. 14 is a block diagram showing the arrangement of a heat signal circuit (PH unit)

FIG. 14 is a block diagram showing the arrangement of a circuit, in the heat signal circuit 905, which generates pre-pulses. Since this circuit arrangement is common to the four colors, FIG. 14 shows only an arrangement for one color. The symbol "a-" in FIG. 14 represents a general term of signal names, which should be represented by different symbols for the respective colors. Referring to FIG. 14, reference numerals 1601 to 1604 denote T0 count circuits; 1611 to 1614, T1 count circuits; and 1621 to 1624, PH output circuits.

In this arrangement, the T0 count circuit 1601, the T1 count circuit 1611, and the PH output circuit 1621 generate the first type of pre-heat pulse signal (a-PH1*). The T0 count circuit 1602, the T1 count circuit 1612, and the PH output circuit 1622 generate the second type of pre-heat pulse signal (a-PH2*). The T0 count circuit 1603, the T1 count circuit 1613, and the PH output circuit 1623 generate the third type of pre-heat pulse signal (a-PH3*). The T0 count circuit 1604, the T1 count circuit 1614, and the PH output circuit 1624 generate the fourth type of pre-heat pulse signal (a-PH4*).

As described above, since the four types of pre-heat pulse signals are generated by the circuits having the same arrangement, only the generation of the pre-heat pulse signal (a-PH1*) will be described below.

The T0 count circuit 1601 counts a time corresponding to the value of T0 for the signal K-PH1* starting from the signal PHCK, then makes a signal SHP active. The T1 count circuit 1611 counts a time corresponding to the value of T1 after the signal SHP becomes active, and makes a signal HHP active. The PH output circuit 1621 generates the signal a-PH1* from the signals SHP and HHP. The signals a-PH2* to a-PH4* are also generated by the same operation as described above.

The pre-pulse signal, therefore, can be generated by connecting two counters. The generation of the main pulse signal requires control for each IC (in this embodiment, as shown in FIG. 4, one printhead includes 11 ICs).

The main pulse can also be generated by connecting two counters as in the case of a pre-pulse.

With the above operation, double pulse control can be properly performed.

A circuit for generating a signal (PT*) for adjusting the internal temperature is constituted by one counter for each of the color components (K, C, M, and Y) of print data.

A signal K-PT* (see FIG. 7) as a heat pulse for this internal temperature control is made active at the leading edge of the signal PHCK, and is made inactive when a time corresponding to the value of T6 (see FIG. 7) set in the K-PT register (not shown) is counted. Signals C-PT*, M-PT*, and Y-PT* also change in the same manner as described above. Temperature control in the printhead, which is based on the signals K-PT*, C-PT*, M-PT*, and Y-PT*, is performed by nozzle heaters which are not used for a print operation.

Although this embodiment exemplifies an ink-jet printer, the present invention is not limited to this and can be applied to a thermosensitive transfer printer using line heads and other types of color printers.

This embodiment also exemplifies a color printer using printheads for four colors. However, the present invention can be equally applied to a printer having at least one line head.

In addition, the constants in this embodiment, e.g., the number of nozzle heaters and the number of LSIs, are merely examples, and the present invention is not limited to them.

Furthermore, this embodiment exemplifies a printer constituted by a formatter and an engine as separate units. As is apparent, however, the present invention can be applied to an integrated printer.

Moreover, the engine in this embodiment is constituted by the two separate circuit blocks. However, the present invention is not limited to this. The engine may be constituted by one circuit block.

According to this embodiment, the pre-heat pulse width is controlled for each nozzle of each printhead, and double pulse control can be performed by selecting optimal pulse widths. Therefore, variations in the ink discharge amounts from one nozzle to another nozzle can be properly corrected. With this operation, high print quality can be maintained.

In addition, since the print data output lines connected to the printheads are used to set pre-heat pulse data therein, the number of signal lines between the printer and the printheads can be reduced, and the printer can be reduced in size.

[Second Embodiment]

Another example of double pulse print control will be described below. Since the basic arrangement of a printer used in this embodiment is the same as that described in the first embodiment, a repetitive description of the arrangement and operation will be avoided. Only the characteristic arrangement and operation of the second embodiment will be described below.

[Description of Double Pulse Print Control]

Double pulse print control as characteristic control in this embodiment will be described next with reference to the arrangement of the printhead IC (head substrate) in FIG. 5, the timing chart in FIG. 7 showing the print sequence, the quiescent time/ink discharge amount characteristics in FIG. 15, and the heat signal circuit (MH unit) in FIG. 16.

As is well-known, in applying a voltage to each nozzle heater, the ink discharge amount can be stabilized by using a method of applying a short pulse (pre-pulse) first, and then applying a long pulse (main pulse) rather than by using a method of applying one longer pulse in one operation. In the former method, control of the ink discharge amounts is called double pulse control. Referring to FIG. 7, reference symbol T1 denotes a pre-pulse; and T3, a main pulse.

In the printhead IC (head substrate) in FIG. 5, a signal PT* is a signal for adjusting the internal temperature of each printhead. When the internal temperature of the printhead is low, this signal is used to apply pulses to nozzle heaters which are not used for a print operation so as to raise the temperature of the printhead. This pulse width is set in a manner such that a CPU-E 161 reads out temperature adjustment pulse data from an EEPROM 401 in the printhead, and then sets the data in a GAE 181. The GAE 181 outputs the signal PT* at the timing shown in FIG. 7 on the basis of the set value ("a-PT*" in FIG. 7 represents a general term corresponding to printheads 190K, 190C, 190M, and 190Y for the respective inks). Signals PHEAT1* to PHEAT4* are also used as control signals for applying pre-pulses during a normal print operation.

Four types of pre-pulse signals are used for the following reason.

Since the ink discharge amounts from the printheads vary depending on the manufacturing processes, density unevenness occurs in an actual print operation in units of nozzles. The width of a pre-heat pulse, therefore, must be changed in units of nozzles in order to prevent such density unevenness. More specifically, a long pre-heat pulse is applied to a nozzle with a small discharge amount, while a short pre-heat pulse is applied to a nozzle with a large discharge amount. For this reason, a plurality of signals for pre-pulses are required in accordance with the ink discharge amounts from the nozzles.

Control associated with the main pulse will be described next.

Since nozzle heaters are manufactured in a semiconductor process, variations of the nozzle heaters in each printhead IC (head substrate) are small, but variations in units of ICs are large. As described above, as the variations of the nozzle heaters increase, density unevenness occurs, and the print quality deteriorates. For this reason, control must be performed to suppress density unevenness by changing the value of T3 representing the main pulse width in units of ICs. For this purpose, the CPU-E 161 reads out head rank data (a parameter which quantifies the degree of density unevenness corresponding to the IC) from the EEPROM 401 in the printhead, and sets the data in the GAE 181. The GAE 181 outputs a signal representing the pulse width (T3) set by a signal MHENB* at a proper timing. With this operation, density unevenness can be prevented in units of ICs.

A method of setting a quiescent time (T2) between the pre-pulse (T1) and the main pulse (T3) will be described next.

Since the printer of this embodiment includes many nozzles, the print width is long. For this reason, the internal temperature of the printhead locally rises at a portion in which printing density is high, but the internal temperature is not so high at a portion in which printing density is low. As a result, a temperature gradient is produced in one printhead. If this temperature gradient becomes steep, the ink discharge amount from each nozzle becomes unstabilized, and density unevenness occurs. For this reason, ink discharge control in consideration of this temperature off-balance is required.

Figure 15:
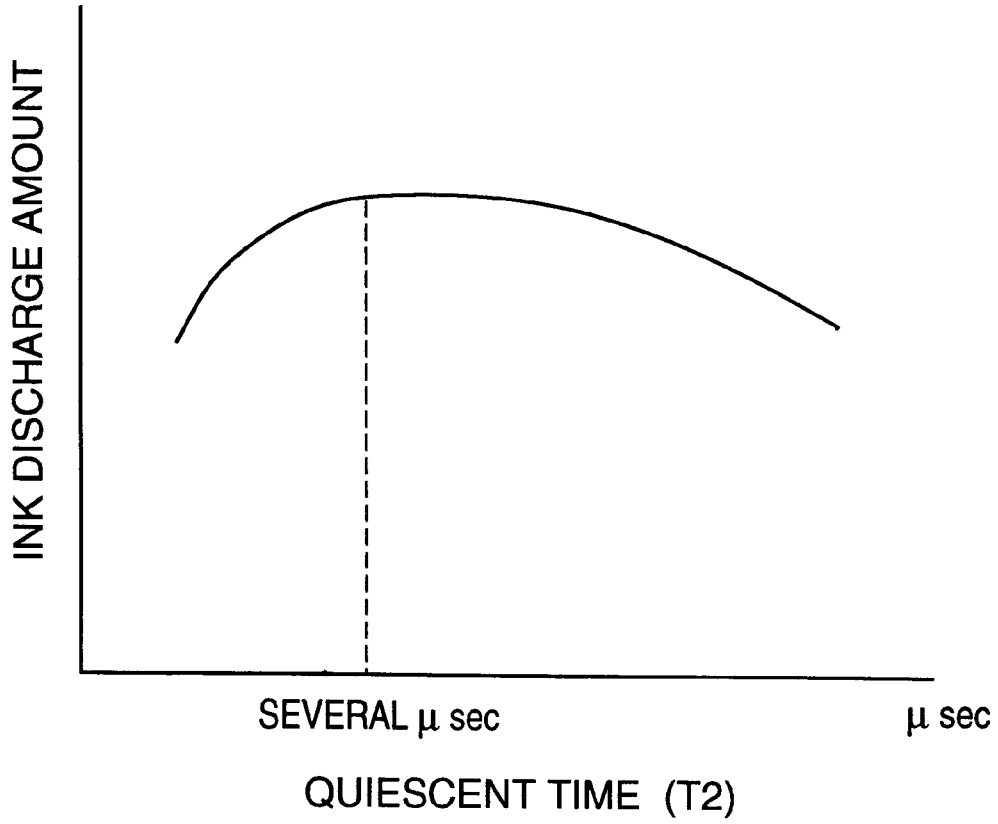
FIG. 15 is a graph showing quiescent time/ink discharge amount characteristics.

FIG. 15 shows the ink discharge amount characteristics indicating the relationship between the ink discharge amount and T2. It is known that the ink discharge amount increases to its peak while the value of T2 remains 0 to several μsec, and then gradually decreases with an increase in the value of T2. This phenomenon is associated with the mechanism of forming bubbles and ink droplets, and is well known. For this reason, a detailed description of the phenomenon will be omitted. According to the above relationship, T2 may be set to be several μsec at a low-temperature portion of the printhead, whereas T2 may be brought closer to "0" at a high-temperature portion. This control can be performed in units of LSIs in the printhead. It is known, however, that the temperature gradient is not so steep as to change in units of LSIs. That is, control in units of groups of LSIs is more advantageous because the control operation is simplified, and it contributes to reducing the circuit size of the head substrate.

In this embodiment, therefore, one printhead is divided into a plurality of portions, and T2 corresponding to the temperature of each divided portion is supplied to the printhead to perform ink discharge control, thereby realizing correction in consideration of the temperature gradient in the printhead.

The head substrate arrangement of the printhead in FIG. 4 is obtained with a division number of "3". The CPU-E 161 detects the representative temperatures of the respective groups from signals DKA1, DIK1, DIA2, DIK2, DIA3, and DIK3 as signals from temperature sensors for the respective groups in the printhead, and sets the values of T5 corresponding to the respective representative temperatures in the GAE 181. The GAE 181 measures the time T5 for each of the three groups, based on the set values, and outputs a main pulse. In this manner, density unevenness caused by a temperature gradient in one printhead can be prevented.

Figure 16A:
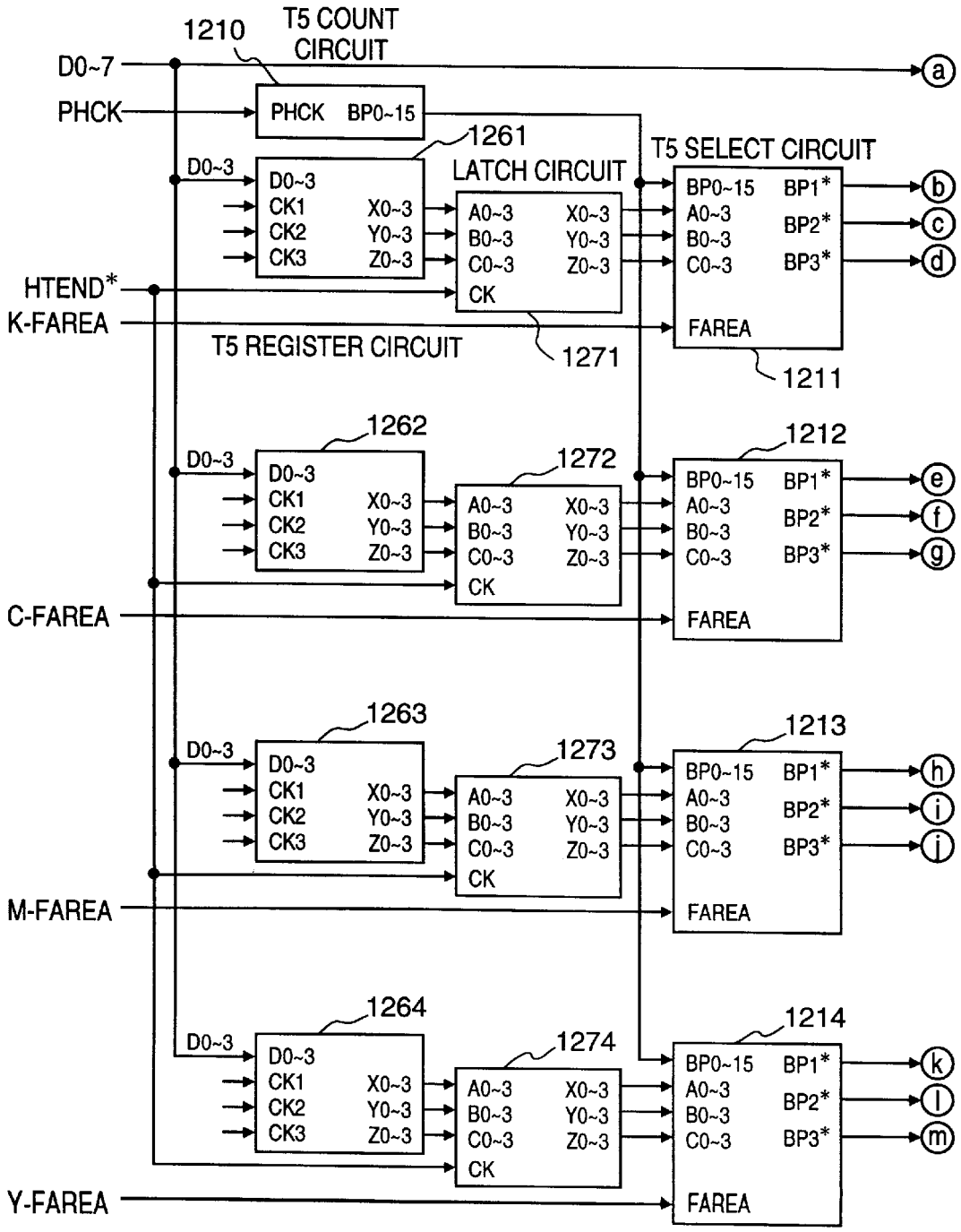
FIGS. 16A and 16B are circuit diagrams showing the detailed arrangement of a heat signal circuit (MH unit)
Figure 16B:
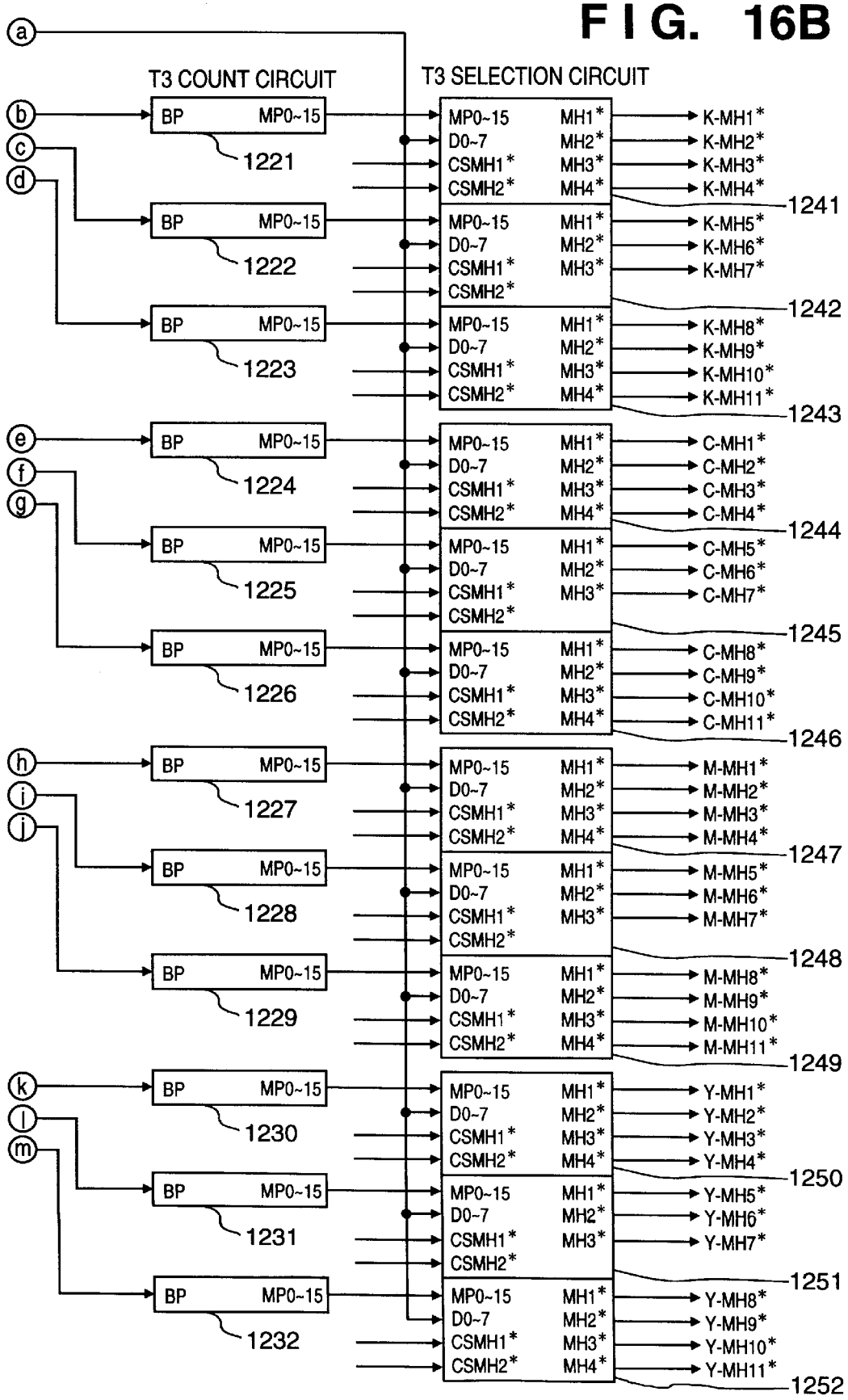

FIGS. 16A and 16B are circuit diagrams showing the detailed arrangement of a heat signal circuit for generating a main pulse (T3).

The heat signal circuit is a circuit for generating the signals PHEAT1* to PHEAT4* and signals MH1* to MH11* required for the above double pulse print control for each ink color. Since these signals are required for each ink color, the signals PHEAT1* to PHEAT4* connected to the printhead 190K are respectively signals K-PH1* to K-PH4*; and the signals MH1* to MH11*, signals K-MH1* to K-MH11*. Similarly, the signals PHEAT1* to PHEAT4* connected to the printhead 190C are respectively signals C-PH1* to C-PH4*; and the signals MH1* to MH11*, signals C-MH1* to C-MH11*. The signals PHEAT1* to PHEAT4* connected to the printhead 190M are respectively signals M-PH1* to M-PH4*; and the signals MH1* to MH11*, signals M-MH1* to M-MH11*. The signals PHEAT1* to PHEAT4* connected to the printhead 190Y are respectively signals Y-PH1* to Y-PH4*; and the signals MH1* to MH11*, signals Y-MH1* to Y-MH11*.

First of all, the signal K-PH1 becomes active after a time corresponding to T0 corresponding to the signal K-PH1 on the basis of a signal PHCK, and becomes inactive after a time corresponding to T1 is counted. A similar operation is performed with respect to the signals K-PH2* to K-PH4*. In addition, the same operation is performed as to the signals C-PH1* to C-PH4*, M-PH1* to M-PH4*, and Y-PH1* to Y-PH4* which are respectively used for discharging inks of the respective colors. In generating a pre-pulse signal, two counters may be connected.

In contrast to this, the generation of the main pulse signal requires control for each IC (in this embodiment, as shown in FIG. 4, one printhead includes 11 ICs). The main pulse can also be generated by connecting two counters as in the case of the pre-pulse. However, since four signals for main pulses are required for each IC, i.e., a total of 44 signals are required, 88 counters are required. Each counter has a large circuit size. That is, the size of a circuit constituted by 88 counters is very large, and this results in deteriorating the reliability of the circuit. For this reason, in this embodiment, the circuit arrangement is designed such that basic pulses are generated for the generation of main pulses, and necessary pulses are selected.

As shown in FIGS. 16A and 16B, the heat signal circuit for generating main pulses is constituted by a T5 count circuit 1210 for generating a pulse of T5 (see FIG. 7), selection circuits 1211 to 1214 therefor, T3 count circuits 1221 to 1232 for generating a pulse of T3 (see FIG. 7), selection circuits 1241 to 1252 therefor, T5 register circuits 1261 to 1264, and latch circuits 1271 to 1274. The total number of counters is 13 according to the above constructed circuit. That is, the circuit size is about ¼ that of the circuit constituted by only counters.

The signal K-MH1 will be described first.

The T5 selection circuit 1211 selects a signal BP as an output from the T5 count circuit 1210 for counting a time corresponding to T5 set in the register (not shown) of group 1 of the printhead 190K, and determines a signal BP1*. The T5 selection circuit 1211 then outputs the signal BP1* to the T3 count circuit 1221. The T3 count circuit 1221 outputs 16 types of main pulses (MP0 to MP15) to the T3 selection circuit 1241. Selection data is set in the K-MH1 register in the T3 selection circuit 1241. The T3 selection circuit 1241 outputs the signal K-MP1* on the basis of the 16 input main pulses (MP0 to MP15).

As is apparent from the circuit arrangement in FIGS. 16A and 16B, since T5 remains the same with respect to the K-MH2* to K-MH4*, the signal BP1* is identical to the signal K-MH1*. However, since T3 is set in units of ICs, the signals respectively set in the K-MH2 register, the K-MH3 register, and the K-MH4 register in the T3 selection circuit 1241 are selected by the T3 selection circuit 1241 to output the signals K-MH2* to K-MH4*.

With respect to the signals K-MH5* to K-MH7*, the value of T5 becomes equal to the value set in the register (not shown) of group 2 of the printhead 190K, and a signal BP2 is determined. The T3 count circuit 1222 performs the same operation as described above to output main pulses (MP0 to MP15). The T3 selection circuit 1242 selects the signal set in the K-MH5 register in the circuit, and outputs the signal K-MH5*. Similar operations are performed to output the signals K-MH6* and K-MH7*.

With respect to the signals K-MH8* to K-MH11*, the value of T5 becomes the value set in the register (not shown) of group 3 of the printhead 190K, and a signal BP3* is determined. Other operations are the same as those described above.

The same operation as that descried above with reference to the black ink discharging operation is performed for signals C-MH1* to C-MH11*, M-MH1* to M-MH11*, and Y-MH1* to Y-MH11* associated with discharging of inks of other colors.

A T5 (see FIG. 7) setting operation will be described below, in which the pulse width is changed in accordance with a change in the temperature of each printhead.

As described above, the value of T3 is stored in the EEPROM 401 in the printhead. When the power supply is turned on, the CPU-E 161 may read out the contents of the EEPROM 401 and set them as signals D0 to D7 in the T3 selection circuits 1241 to 1252. However, since the value of T5 must be changed in accordance with a change in temperature, the CPU-E 161 periodically reads the value of a temperature sensor in the printhead and sets values in the T5 selection circuits 1211 to 1214 of the GAE 181 in accordance with the signals D0 to D3. Since the CPU-E 161 does not manage the energization timings of nozzle heaters, the value of T5 may change during the period of sending an electricity to the nozzle heaters. In this case, abnormal pulses may be applied to the nozzle heaters. As a result, the nozzle heaters may be damaged. In order to prevent this, therefore, the printer needs a circuit arrangement for preventing T5 from being changed during the period of sending an electricity to the nozzle heaters.

This is realized by the T5 register circuits 1261 to 1264 and the latch circuits 1271 to 1274. The latch circuits 1271 to 1274 cause a main pulse signal to reflect information from the CPU-E 161, which is set in the T5 register circuits 1261 to 1264, with a delay of one line. With this operation, damage to the nozzle heaters can be prevented. Since the value of T5 does not change during the period of printing one line, no abrupt change in ink discharge amount occurs in the process of printing one line. Density unevenness of a printed image, therefore, can be prevented.

Double pulse control can be properly performed with the above operation.

A signal K-PT* (FIG. 7) as a heat pulse for temperature control is made active at the leading edge of the signal PHCK, and is made inactive after a time corresponding to the value of T6 (see FIG. 7) set in the K-PT register (not shown). This circuit is therefore constituted by one counter. The same circuit arrangement is used for signals C-PT*, M-PT*, and Y-PT*.

This embodiment exemplifies an ink-jet printer. However, the present invention is not limited to this and can be applied to a thermosensitive transfer printer using line heads and other types of color printers.

This embodiment also exemplifies a color printer using printheads for four colors. However, the present invention can be equally applied to a printer having at least one line head.

In addition, the constants in this embodiment, e.g., the number of nozzle heaters and the number of LSIs, are only examples, and the present invention is not limited to them.

Furthermore, this embodiment exemplifies a printer constituted by a formatter and an engine as separate units. As is apparent, however, the present invention can be applied to an integrated printer.

Moreover, the engine in this embodiment is constituted by the two separate circuit blocks. However, the present invention is not limited to this. The engine may be constituted by one circuit block.

According to this embodiment, therefore, even in a printhead having a long print width, pulse quiescent time control for each group in the printhead and main pulse width control for each IC are performed in consideration of (1) a temperature gradient and a change in temperature in the printhead and (2) variations of ICs. With this control, the ink discharge amounts from the respective nozzles are made uniform to allow a print operation with high print quality. In addition, since the circuit for the above control is designed to minimize the number of counters, the circuit size can be reduced, and the overall size of the printer can also be reduced.

[Third Embodiment]

Another example of double pulse print control will be described below. Since the basic arrangement of a printer used in this embodiment is the same as that described in the first embodiment, a repetitive description of the arrangement and operation will be avoided. Only the characteristic arrangement and operation of the second embodiment will be described below.

Figure 17:
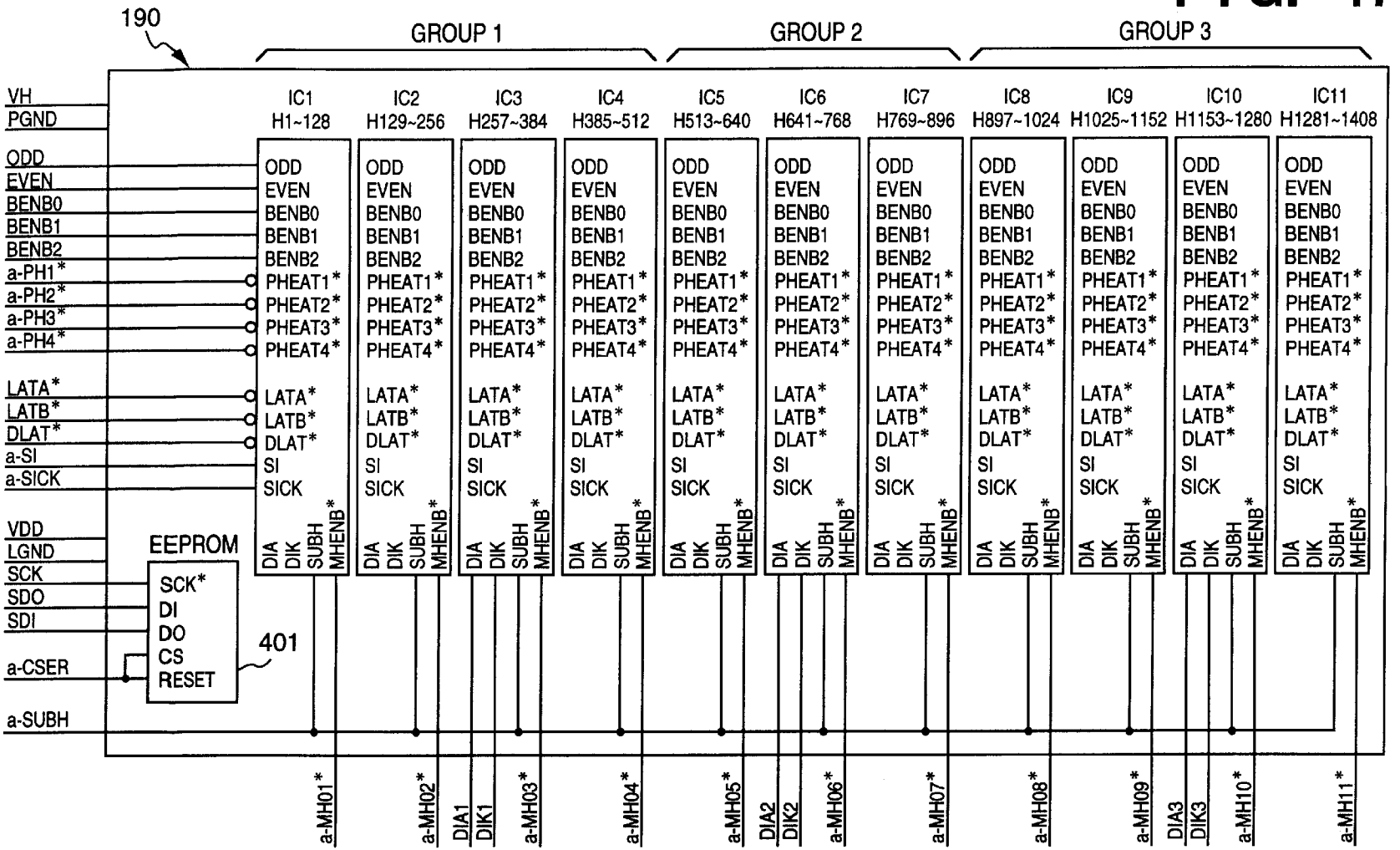
FIG. 17 is a view showing a full-line printhead corresponding to one color according to a third embodiment of the present invention.

FIG. 17 shows the arrangement of a printhead for one color according to this embodiment. The arrangement of the printhead in FIG. 17 is the same as that of the first embodiment described with reference to FIG. 4 except that there is no signal PT* which is input to each IC in the first and second embodiments. A description of this embodiment, therefore, will be omitted.

Figure 18:
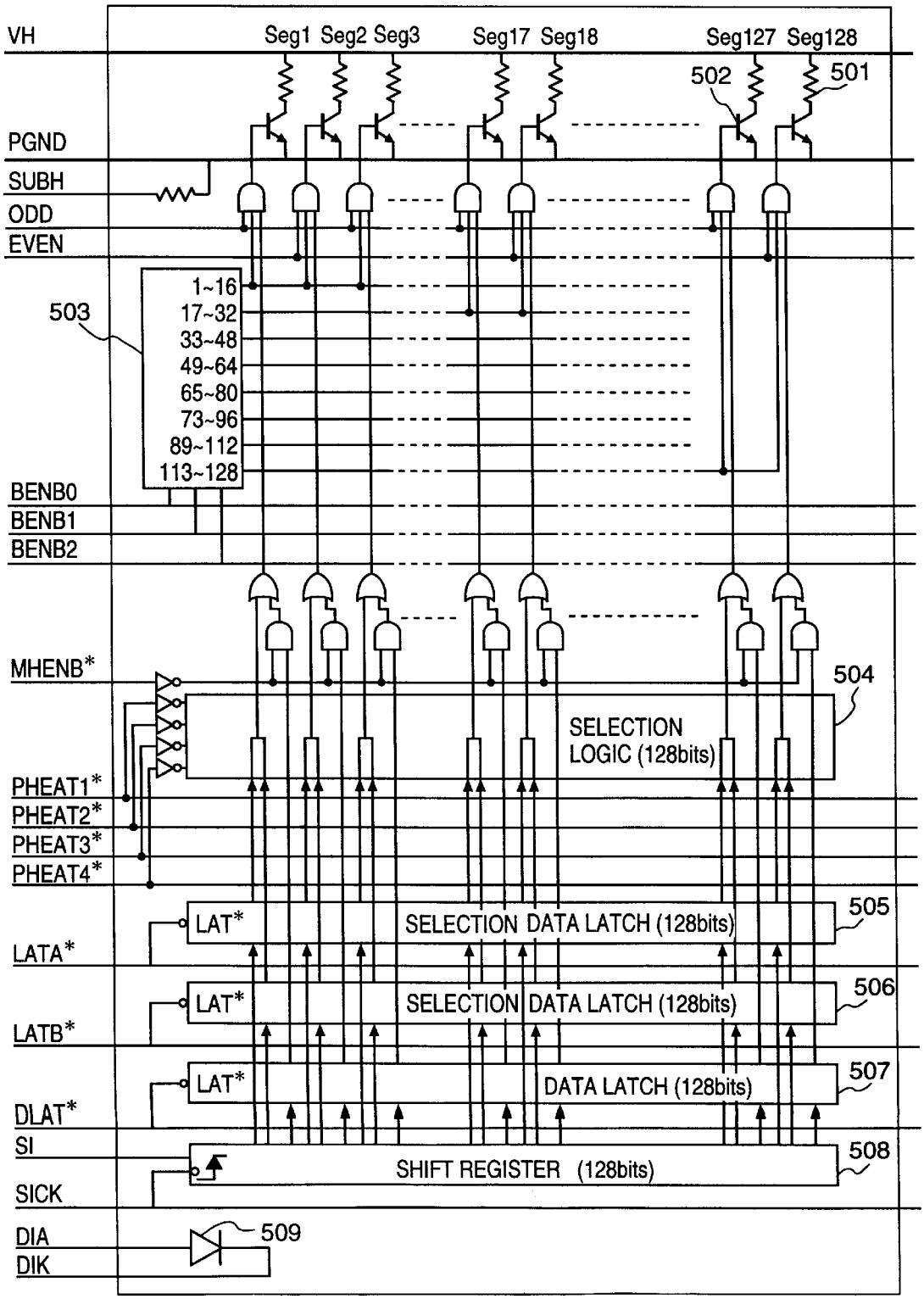
FIG. 18 is a circuit diagram showing the arrangement of a head IC of the printhead according to the third embodiment.

FIG. 18 shows the arrangement of a head IC of the printhead according to this embodiment. The arrangement of the head IC in FIG. 18 is the same as that of the head IC in FIG. 5 described in the first embodiment except that no gate for inputting the signal PT* is used. A description of this arrangement, therefore, will be omitted.

FIGS. 19A to 19B comprise a timing chart showing a basic print sequence according to this embodiment. The signals shown in FIGS. 19A to 19B, are the same as those in FIGS. 7A to 7R described in the first embodiment, except that the signal PT* is not included.

Referring to FIG. 19, reference numeral 701 denotes the energization timing of the 1st heater, the 17th heater, the 33rd heater, . . . , the 1,393rd heater. At the timing 701, since data (DATA) is "0", only the heat pulses based on a signal a-PH* are applied: Reference numeral 702 denotes the heat timing of the 2nd heater, the 18th heater, the 34th heater, . . . , the 1,394th heater. At the timing 702, since data is "1", main heat pulses of a width T3 are applied after a pre-heat period of a width T1 and a quiescent period of a width T2. Reference numeral 703 denotes the heat timing of the 3rd heater, the 19th heater, the 35th heater, . . . , the 1,395 heater. Similar to the timing 701, at the timing 703, since data is "0", only the heat pulses based on the signal a-PH* are applied.

Figure 20A:
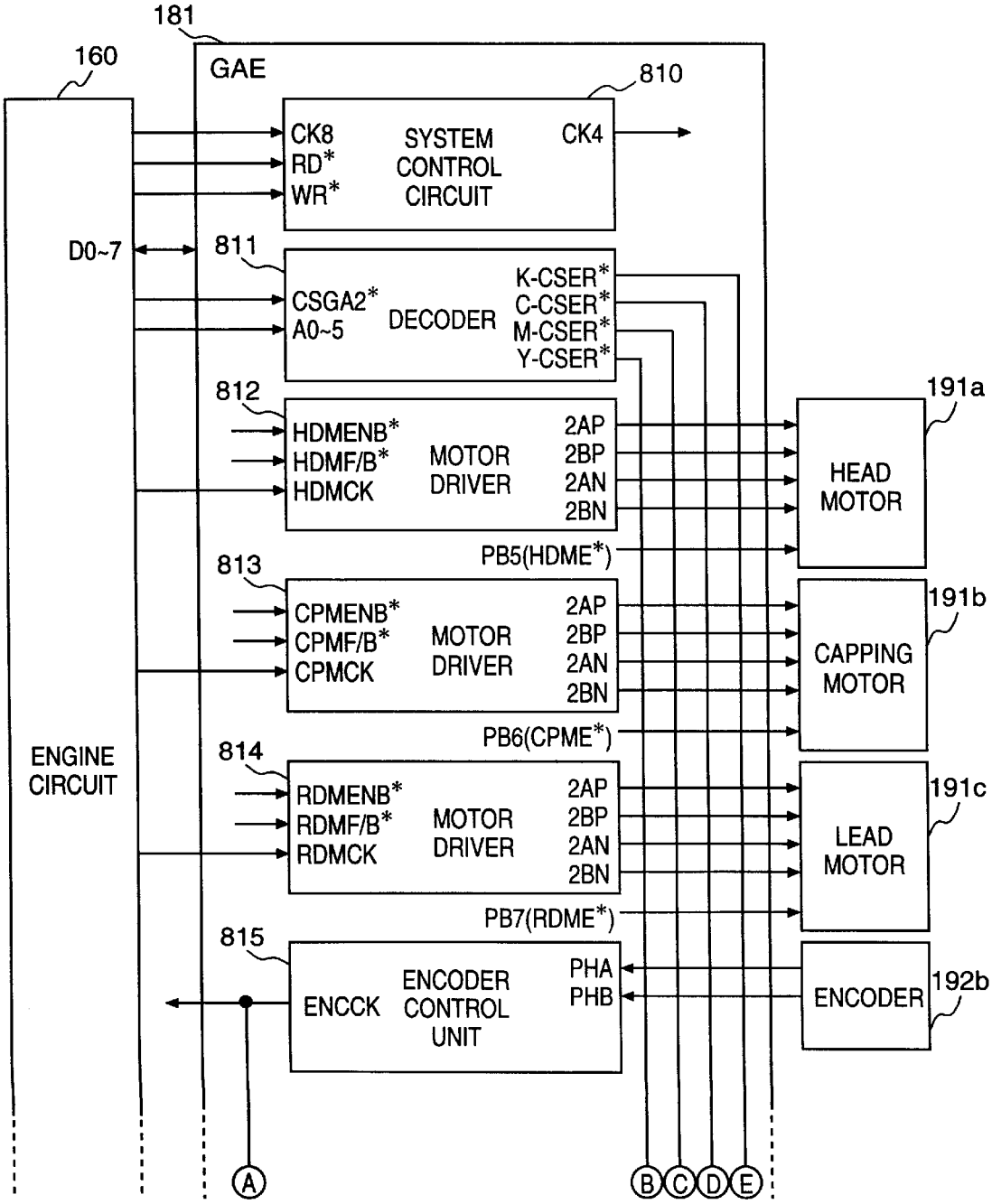
FIGS. 20A and 20B are block diagrams showing the arrangements of a GAE 181 in an engine circuit 180 according to the third embodiment.
Figure 20B:
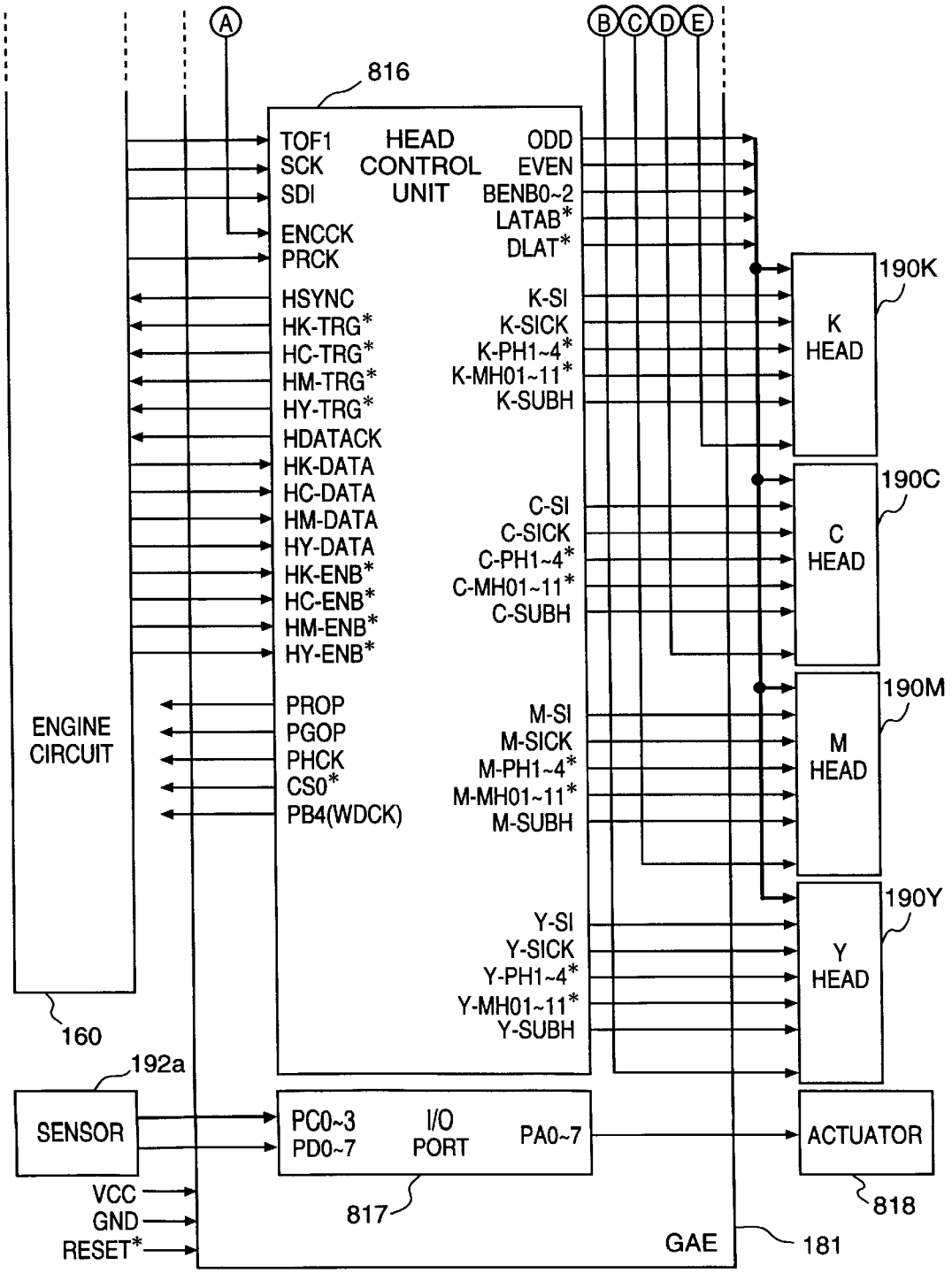

FIGS. 20A and 20B are block diagrams showing the arrangements of an engine circuit 180 and a GAE 181 according to this embodiment. Unlike in the arrangements in FIGS. 8A and 8B, described in the first embodiment, in the arrangements of this embodiment, the signals K-PT*, C-PT*, M-PT*, and Y-PT* used in the first embodiment need not be output from an encoder control unit 815 to printheads 190K, 190C, 190M, and 190Y. Since other arrangements are the same as those of the first embodiment, a description thereof will be omitted.

Figure 21A:
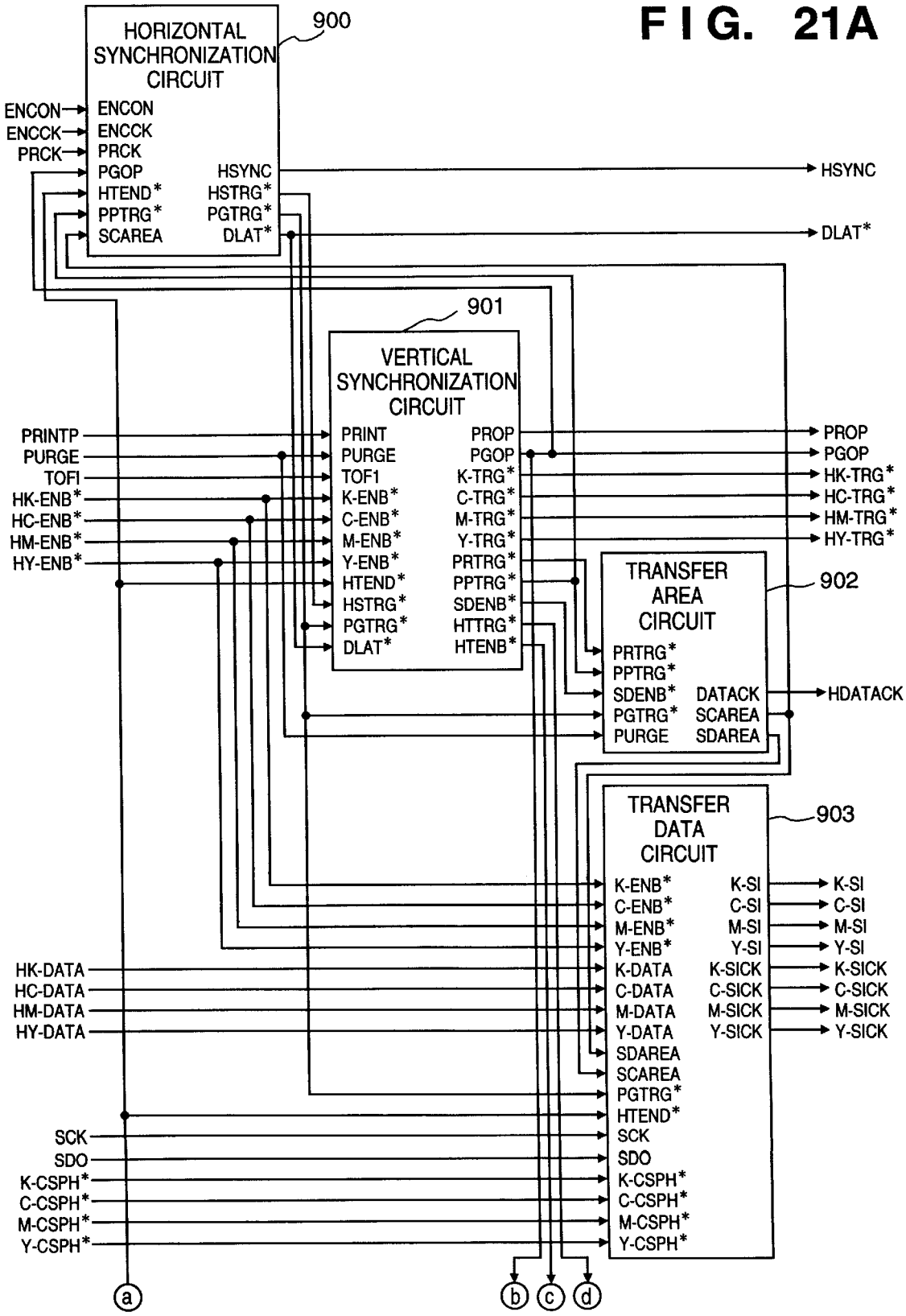
FIGS. 21A and 21B are block diagrams showing the arrangement of a head control unit 816 of the GAE 181 according to the third embodiment.
Figure 21B:
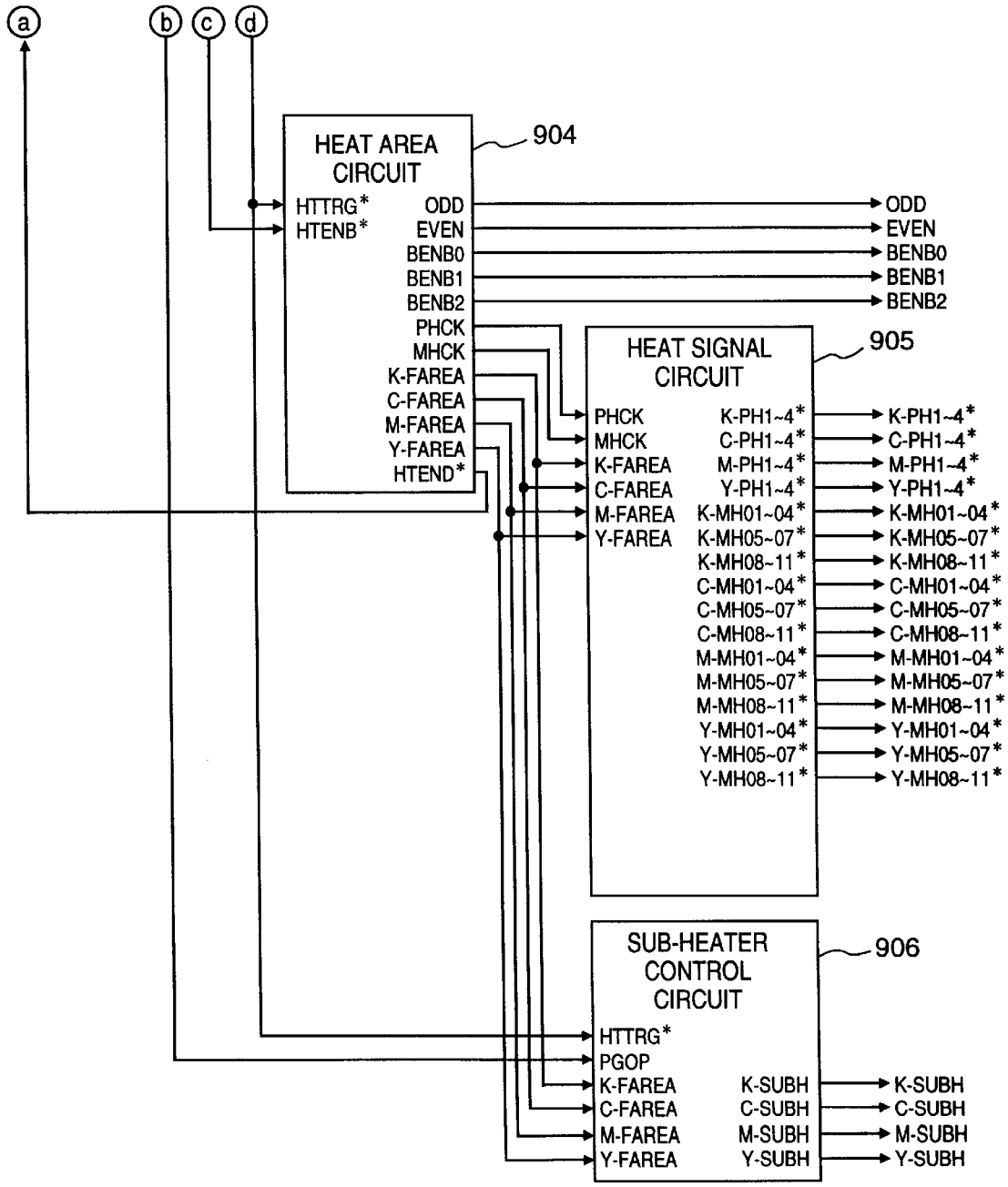

FIGS. 21A and 21B are block diagrams showing the arrangement of a head control unit 816 of the GAE 181 according to this embodiment. Unlike in the arrangement in FIGS. 9A and 9B, described in the first embodiment, in the arrangement of this embodiment, the signals K-PT*, C-PT*, M-PT*, and Y-PT* output in the first embodiment need not be output from a heat signal circuit 905. That is, the heat signal circuit 905 in this embodiment is a circuit for generating signals PHEAT1* to PHEAT4* and signals MH1* to MH11* required to perform a print operation based on double pulse control for each color. The heat signal circuit 905 will be described in detail later. Since other arrangements are the same as those in the first embodiment, a description thereof will be omitted.

Detailed Description of Double Pulse Print Control (Pre-heat Pulse Control in Particular)

Pre-heat pulse control, in double pulse print control, which is characteristic operation control in this embodiment, will be described below. As is well-known, in applying a voltage to each nozzle heater, the ink discharge amount can be stabilized by using a method of applying a short pulse (pre-pulse) first, and then applying a long pulse (main pulse) rather than by using a method of applying one longer pulse in one operation. Portions T1 and T3 in FIG. 19 respectively correspond to the pre-pulse and the main pulse.

These pre-pulses and main pulses are required for each ink color (or each printhead). For this reason, the signals PHEAT1* to PHEAT4* connected to the printhead 190K are respectively signals K-PH1* to K-PH4*; and the signals MH1* to MH11*, signals K-MH1* to K-MH11*. Similarly, the signals PHEAT1* to PHEAT4* connected to the printhead 190C are respectively signals C-PH1* to C-PH4*; and the signals MH1* to MH11*, signals C-MH1* to C-MH11*. The signals PHEAT1* to PHEAT4* connected to the printhead 190M are respectively signals M-PH1* to M-PH4*; and the signals MH1* to MH11*, signals M-MH1* to M-MH11*. The signals PHEAT1* to PHEAT4* connected to the printhead 190Y are respectively signals Y-PH1* to Y-PH4*; and the signals MH1* to MH11*, signals Y-MH1* to Y-MH11*.

A full-line type printhead having a long print width like this embodiment has many ink discharge nozzles, and hence many nozzle heaters. For this reason, when a high-density print operation is performed, the nozzle heaters generate large quantities of heat, and the internal temperature of the printhead rises. As a result, it is difficult to maintain the internal temperature within the temperature range for a proper print operation. The printer of this embodiment includes a cooling fan to prevent such a rise in temperature so as to prevent an abnormal rise in the internal temperature of the printhead. In the embodiment, with the following arrangement, when the internal temperature of the printhead rises to a predetermined temperature or more, no pre-pulse is generated in pre-pulse print control to suppress an increase in the quantity of heat generated from each nozzle heater.

Figure 22:
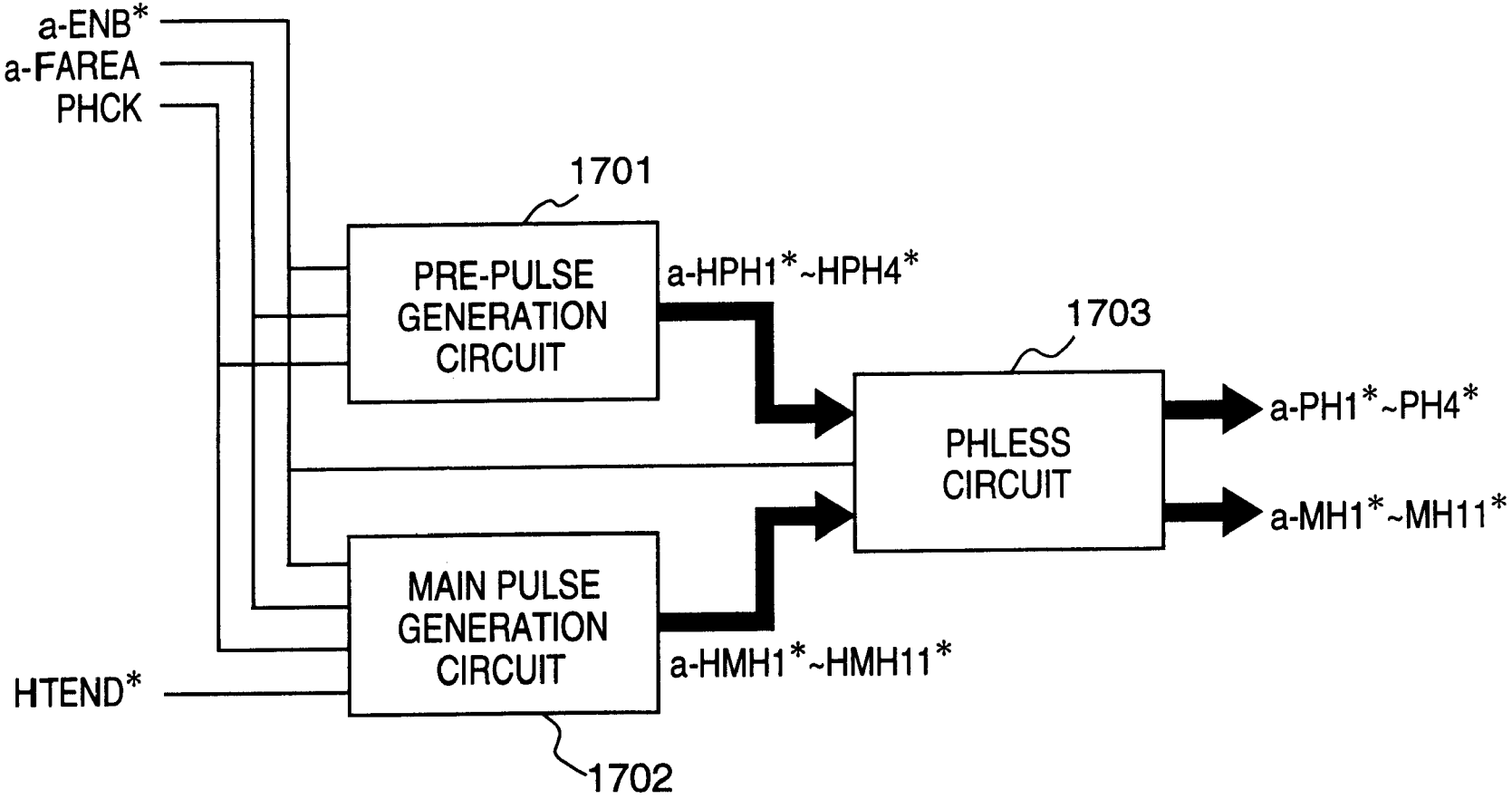
FIG. 22 is a block diagram showing the arrangement of a heat signal circuit (PH unit)

FIG. 22 is a circuit diagram showing the detailed arrangement of the heat signal circuit. Since this circuit arrangement is common to print operations using four types of inks or the four printheads, FIG. 22 shows an arrangement for one printhead. For the sake of descriptive convenience, the symbol "a-" of each signal name in FIG. 22 is used as a general term, although different signals are used for the printheads of the respective inks. In practice, therefore, for example, a signal a-FAREA includes signals K-FAREA, C-FAREA, M-FAREA, and Y-FAREA according to the types of printheads.

Referring to FIG. 22, reference numeral 1701 denotes a pre-pulse generation circuit; 1702, a main pulse generation circuit; and 1703, a PHLESS circuit.

The pre-pulse generation circuit 1701 generates signals a-PH1* to a-PH4*. These signals are generated as follows. A CPU-E 161 reads out pre-pulse data from an EEPROM 401 in each printhead, and sets the data in the GAE 181. With this operation, a counter in the pre-pulse generation circuit 1701 as an internal circuit of the GAE 181 generates and outputs four types of pre-pulse signals (a-HPH1* to a-HPH4*) on the basis of a signal PHCK.

The main pulse generation circuit 1702 performs a similar operation. That is, the CPU-E 161 reads out head rank data from the EEPROM 401 in the printhead, and sets the data in the GAE 181. With this operation, a counter in the main pulse generation circuit 1702 as an internal circuit of the GAE 181 generates and outputs main pulse signals (a-HMH1* to a-HMH11*) for the respective ICs (ICs 1 to 11) on the basis of the signal PHCK.

The PHLESS circuit 1703 is a circuit for selecting, in accordance with the value set by the CPU-E 161 and stored in the a-PHOFF register (not shown) in the GAE 181, whether or not to output a pre-pulse. Assume that the CPU-E 161 determines, on the basis of the printing density attained by the printheads 190K, 190C, 190M, and 190Y of the printer and temperature information from temperature sensors arranged in the printheads, that the printing density is low or the temperatures of the printheads have decreased because of a low operation environmental temperature. In this case, the CPU-E 161 sets "0" in the a-PHOFF register. On the other hand, when the printing density is high or the operation environmental temperature is high, the CPU-E 161 sets "1" in the a-PHOFF register.

Figure 23:
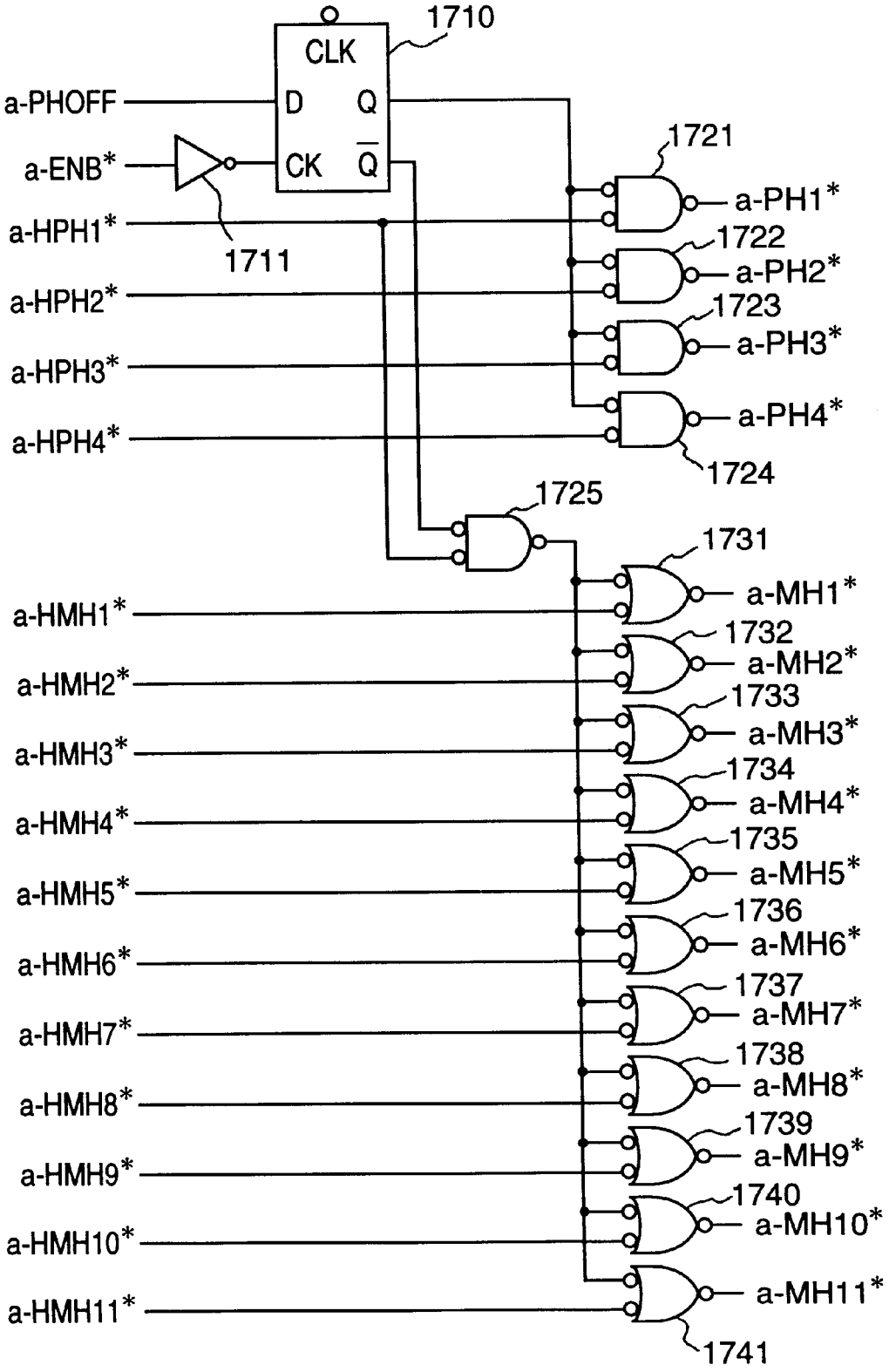
FIG. 23 is a block diagram showing the arrangement of a PHLESS circuit in FIG. 22.

FIG. 23 is a circuit diagram showing the detailed arrangement of the PHLESS circuit 1703. Referring to FIG. 23, reference numeral 1710 denotes a flip-flop; 1711, an inverter; 1721 to 1725, AND circuits; and 1731 to 1741, OR circuits.

With the above circuit arrangement, when "0" is set in the a-PHOFF register, pre-pulse signals (a-HPH1* to a-HPH4*) generated by the pre-pulse generation circuit 1701 are directly output as pre-pulse selection signals (a-PH1* to a-PH4*), and main pulse signals (a-HMH1* to a-HMH11*) generated by the main pulse generation circuit 1702 are directly output as main pulse signals (a-MH1* to a-MH11*). With this operation, when the printing density is low or the internal temperature of each printhead has decreased because of a low operation environmental temperature, pre-pulses are applied to all the nozzle heaters in the printhead to uniformly heat the printhead. Therefore, the ink discharge amount from each nozzle is stabilized.

When "1" is set in the a-PHOFF register, outputting of pre-pulse selection signals (a-PH1* to a-PH4*) is inhibited. In this case, only one pre-pulse signal (a-HPH1*) is commonly applied to the OR circuits 1731 to 1741. With this operation, signals based on the logical sums between the signal a-PH1* and the respective main pulses are respectively applied to only nozzle heaters, of the nozzle heaters of the printhead, for which print data are present. Thus, double pulse control is substantially executed for the nozzle heaters used for a print operation. In contrast to this, a heating operation using pre-pulses is not performed for the nozzle heaters which are not used for the print operation.

According to this embodiment, when it is determined, on the basis of the printed state information from each printhead or the internal temperature of each printhead, which are monitored by the CPU, that the printing density is high or the operation environmental temperature is high, double pulse print control is performed such that no pre-pulses are applied to the printhead, and double pulses are substantially applied to only the nozzle heaters which are used for a print operation. With this control, the total quantity of heat generated by the nozzle heaters is suppressed low, and a rise in the temperature of each printhead can be suppressed. Even if, therefore, the printing density is high or the operation environmental temperature is high, high print quality can be maintained.

A combination of the control in this embodiment and the operation of the cooling fan will enhance the cooling effect. In addition, in consideration of the heat generation suppressing effect for each nozzle heater in this embodiment, the cooling fan itself can be reduced in size.

This embodiment exemplifies an ink-jet printer. However, the present invention is not limited to this and can be applied to a thermosensitive transfer printer using line printheads and other types of color printers.

This embodiment also exemplifies a color printer using printheads for four colors. However, the present invention can be equally applied to a printer having at least one line printhead.

In addition, the constants in this embodiment, e.g., the number of nozzle heaters and the number of LSIs, are examples, and the present invention is not limited to them.

Furthermore, this embodiment exemplifies a printer constituted by a formatter and an engine as separate units. As is apparent, however, the present invention can be applied to an integrated printer.

Moreover, the engine in this embodiment is constituted by the two separate circuit blocks. However, the present invention is not limited to this. The engine may be constituted by one circuit block.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, it goes without saying that the invention is also applicable to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus using a printhead for printing an image on a recording medium by driving M electrothermal transducers and M print elements corresponding to said electrothermal transducers, respectively, according to double pulse control, comprising:

monitoring means for monitoring a temperature of said printhead;

input means for inputting print data;

driving means for driving said printhead by not only applying pre-pulse signals to said M electrothermal transducers but also applying main pulse signals to electrothermal traducers corresponding to print elements required for a print operation on the basis of the print data after an interval time has passed from the application of the pre-pulse signals; and drive control means for controlling said driving means on the basis of the temperature and a printing density obtained from the print data such that the pre-pulse signals are applied to only electrothermal transducers to which the main pulse signals are applied, thereby reducing an amount of heat energy generated by said M electrothermal transducers.

2. The printing apparatus according to claim 1, wherein said printhead includes four printing units for performing print operations corresponding to black, cyan, magenta, and yellow.

3. The printing apparatus according to claim 1, wherein said printhead is an ink-jet head for printing an image on a recording medium by discharging an ink.

4. The printing apparatus according to claim 3, wherein said printhead is a printhead for discharging an ink by using heat energy, and includes a transducer for generating heat energy to be applied to the ink.

5. The printing apparatus according to claim 1, wherein said printhead includes a sensor for monitoring the internal temperature of said printhead.

6. The printing apparatus according to claim 1, wherein said driving means includes:

M driving circuits corresponding to said M electrothermal transducers, respectively; and division control means for dividing said M driving circuits into N groups and performing control in units of groups, said monitoring means includes temperature measurement means for measuring the temperature of said printhead for each of the groups, and said driving means drives said printhead through said M driving circuits to perform a print operation by applying a first pulse to each of said M print elements, and applying a second pulse following the first pulse.

7. The printing apparatus according to claim 6, further comprising:

first adjustment means for adjusting a width of the second pulse for each of said M driving circuits on the basis of variations in operations of said M driving circuits; and second adjustment means for adjusting a pulse interval of the first and second pulses on the basis of N temperatures measured by said temperature measurement means.

8. The printing apparatus according to claim 6, wherein said printhead includes storage means for storing information representing the variations in the operations of said M driving circuits.

9. The printing apparatus according to claim 7, wherein said second adjustment means obtains a temperature gradient in said printhead from the N temperatures and adjusts the pulse interval on the basis of the temperature gradient.

10. The printing apparatus according to claim 6, further comprising inhibition means for, when said printhead is performing a print operation, inhibiting pulse control based on changes in the N temperatures until the print operation for one line is completed.

11. The printing apparatus according to claim 1, further comprising:

latch means for latching printing characteristic information associated with said M print elements in correspondence with said M electrothermal transducers;

signal input means for inputting a plurality of pre-pulse signals;

selection means for selecting an optimal pre-pulse signal for each of said M print elements on the basis of the plurality of pre-pulses input by said signal input means and the printing characteristic information latched by said latch means;

pre-heat means for performing a pre-heating operation by sending electricity to said M electrothermal transducers using the optimal pre-pulse signals selected by said selection means;

output means for outputting the printing characteristic information to said printhead; and application means for applying a plurality of pre-pulses to said printhead.

12. The printing apparatus according to claim 11, wherein said output means outputs the printing characteristic information by using a signal for outputting print data to said printhead, when a power supply of said printer is turned on.

13. The printing apparatus according to claim 11, further comprising memory means included in said printhead, for storing the printing characteristic information.

14. The printing apparatus according to claim 13, wherein said memory means is an EEPROM.

15. A printing apparatus including a printhead which integrates M electrothermal transducers; a latch circuit latching printing characteristic information associated with said M electrothermal transducers; an input terminal inputting a plurality of pre-pulse signals, each having a different pulse width, and a plurality of main pulse signals; and a selector selecting a pre-pulse signal for each of M print elements on the basis of the plurality of pre-pulse signals input from said input terminal and the printing characteristic information latched by said latch circuit comprising:

output means for outputting the printing characteristic information to said input terminal in said printhead; and application means for applying a plurality of pre-pulse signals and main pulse signals to said printhead, wherein said printhead performs a preheating operation by sending electricity to said M electrothermal transducers by using the pre-pulse signals selected by said selector, and performs a printing operation by selectively applying the main pulse signal to said M electrothermal transducers after the preheating operation.

16. The printing apparatus according to claim 15, wherein said output means outputs the printing characteristic information by using a signal for outputting print data to said printhead, when a power supply of said printing apparatus is turned on.

17. The printing apparatus according to claim 15, wherein said printhead includes four printing units for performing image print operations corresponding to black, cyan, magenta, and yellow.

18. The printing apparatus according to claim 15, wherein said printhead is an ink-jet head for printing an image on a recording medium by discharging an ink.

19. The printing apparatus according to claim 18, wherein said printhead is a printhead for discharging an ink by using heat energy, and includes a transducer for generating heat energy to be applied to the ink.

20. The printing apparatus according to claim 15, further comprising memory means, included in said printhead, for storing the printing characteristic information.

21. The printing apparatus according to claim 20, wherein said memory means is an EEPROM.

22. A printing apparatus for generating print image data by receiving print image data from an external device, and printing an image on a recording medium on the basis of the print image data by using a printhead having a plurality of print elements, and driving said plurality of print elements by using N driving circuits, comprising:

division control means for dividing said N driving circuits into M groups and performing control in units of groups;

temperature measurement means for measuring a temperature of said printhead for each of the groups;

driving means for driving said printhead through said N driving circuits to perform a print operation by applying a first pulse to each of said plurality of print elements, and applying a second pulse following the first pulse, wherein an interval time exists between the application of the first pulse and the application of the second pulse;

first adjustment means for adjusting a width of the second pulse for each of said N driving circuits on the basis of variations in printing operations of said plurality of print elements; and second adjustment means for adjusting the interval time on the basis of M temperatures measured by said temperature measurement means.

23. The printing apparatus according to claim 22, wherein said printhead includes storage means for storing information representing the variations in the operations of said N driving circuits.

24. The printing apparatus according to claim 22, wherein said printhead includes four printing units for performing image print operations corresponding to black, cyan, magenta, and yellow.

25. The printing apparatus according to claim 22, wherein said second adjustment means obtains a temperature gradient in said printhead from the M temperatures and adjusts the pulse interval on the basis of the temperature gradient.

26. The printing apparatus according to claim 22, wherein said printhead is an ink-jet head for printing an image on a recording medium by discharging an ink.

27. The printing apparatus according to claim 26, wherein said printhead is a printhead for discharging an ink by using heat energy, and includes a transducer for generating heat energy to be applied to the ink.

28. The printing apparatus according to claim 22, further comprising inhibition means for, when said printhead is performing a print operation, inhibiting pulse control based on changes in the M temperatures until the print operation for one line is completed.

29. A printing apparatus for printing an image by using a printhead in which a plurality of electrothermal transducers are arrayed, and ink is discharged from a plurality of orifices by driving the plurality of electrothermal transducers, comprising:

a pre-pulse generation circuit for generating a pre-pulse to be applied to the plurality of electrothermal transducers so as to generate thermal energy insufficient to discharge ink;

a main-pulse generation circuit for generating a main-pulse to be applied to the plurality of electrothermal transducers so as to generate thermal energy causing ink to be discharged;

a driving circuit for driving said printhead by selectively applying the main-pulse to the plurality of electrothermal transducers, based on an image signal; and a pre-pulse supply control circuit for controlling a supply of the pre-pulse, generated by said pre-pulse generation circuit, to said printhead, based on an input of a predetermined signal, wherein said pre-pulse supply control circuit controls a switching between a mode in which the pre-pulse is applied to the plurality of electrothermal transducers regardless of selective driving of the plurality of electrothermal transducers based on the image signal, and another mode in which the pre-pulse is applied to the electrothermal transducer to which the main-pulse is applied.

30. The apparatus according to claim 29, wherein said pre-pulse generation circuit generates a plurality of pre-pulses having widths different from each other.

31. The apparatus according to claim 30, further comprising a selection circuit for selecting one of the plurality of pre-pulses, and applying the selected pre-pulse to each of the plurality of electrothermal transducers.

32. The apparatus according to claim 31, wherein, in a case where the pre-pulse is applied to the electrothermal transducer to which the main-pulse is also applied, said pre-pulse supply control circuit applies a predetermined pre-pulse of the plurality of pre-pulses.

33. The apparatus according to claim 29, wherein the predetermined signal is inputted, based on at least one of a temperature of said printhead and a print duty indicated by the image signal.

34. The apparatus according to claim 29, wherein said printhead is an ink-jet printhead equipped with the plurality of electrothermal transducers, each corresponding to one of the plurality of orifices, for generating thermal energy applied to ink so as to discharge the ink by utilizing the thermal energy.

35. A drive control circuit for driving a printhead in which a plurality of electrothermal transducers are arrayed, and ink is discharged from a plurality of orifices, comprising:

a pre-pulse generation circuit for generating a pre-pulse to be applied to the plurality of electrothermal transducers so as to generate thermal energy insufficient to discharge ink;

a main-pulse generation circuit for generating a main-pulse to be applied to the plurality of electrothermal transducers so as to generate thermal energy causing ink to be discharged;

a driving circuit for driving said printhead by selectively applying the main-pulse to the plurality of electrothermal transducers, based on an image signal; and a pre-pulse supply control circuit for controlling a supply of the pre-pulse, generated by said pre-pulse generation circuit, to said printhead, based on an input of a predetermined signal, wherein said pre-pulse supply control circuit controls a switching between a mode in which the pre-pulse is applied to the plurality of electrothermal transducers regardless of selective driving of the plurality of electrothermal transducers based on the image signal, and another mode in which the pre-pulse is applied to the electrothermal transducer to which the main-pulse is applied.

36. The drive control circuit according to claim 35, wherein said pre-pulse generation circuit generates a plurality of pre-pulses having widths different from each other.

37. The drive control circuit according to claim 36, further comprising a selection circuit for selecting one of the plurality of pre-pulses, and applying the selected pre-pulse to each of the plurality of electrothermal transducers.

38. The drive control circuit according to claim 37, wherein, in a case where the pre-pulse is applied to the electrothermal transducer to which the main-pulse is also applied, said pre-pulse supply control circuit applies a predetermined pre-pulse of the plurality of pre-pulses.

39. The drive control circuit according to claim 35, wherein the predetermined signal is inputted, based on at least one of a temperature of said printhead and a print duty indicated by the image signal.

40. The drive control circuit according to claim 35, wherein said printhead is an ink-jet printhead equipped with the plurality of electrothermal transducers, each corresponding to one of the plurality of orifices, for generating thermal energy applied to ink so as to discharge the ink by utilizing the thermal energy.

41. An image forming apparatus for forming an image by using a printhead in which a plurality of electrothermal transducers are arrayed, and ink is discharged from a plurality of orifices by driving the plurality of electrothermal transducers, comprising:

a pre-pulse generation circuit for generating a pre-pulse to be applied to the plurality of electrothermal transducers so as to generate thermal energy insufficient to discharge ink;

a main-pulse generation circuit for generating a plurality of main-pulses, having widths different from each other, to be applied to the plurality of electrothermal transducers so as to generate thermal energy causing ink to be discharged;

a memory for storing characteristic information corresponding to each of the plurality of electrothermal transducers;

a driving circuit for driving said printhead by selectively applying the pre-pulse and one of the plurality of the main-pulses to the plurality of electrothermal transducers, based on an image signal;

detection means for detecting a temperature distribution in a arrayed direction of the plurality of electrothermal transducers in said printhead; and adjustment means for adjusting an interval time between a pre-pulse and the main-pulse to be applied to each of the plurality of electrothermal transducers, based on the temperature distribution detected by said detection means, wherein said driving circuit selectively applies one of the plurality of main-pulses, based on the characteristic information, after the pre-pulse has been applied and the interval time has passed.

42. The apparatus according to claim 41, wherein said printhead is an ink-jet printhead equipped with the plurality of electrothermal transducers, each corresponding to one of the plurality of orifices, for generating thermal energy applied to ink so as to discharge the ink by utilizing the thermal energy.

* * * * *

UNITED STATES PATENT AND TRADEMARK OFFICE

CERTIFICATE OF CORRECTION

PATENT NO. : 5,969,730

DATED : October 19, 1999

INVENTOR(S) : SHIGERU INOSE, ET AL.

It is certified that error appears in the above-identified patent and that said Letters Patent is hereby corrected as shown below:

Title page,item

[56] References Cited:

FOREIGN PATENT DOCUMENTS, after "60-071260 4/1985 Japan",
--0 288 044 10/1988 Europe-- and
--63-267559 11/1988 Japan-- should be inserted; and after
"1-127361 5/1989 Japan"
--2 220 892 1/1990 Great Britain-- should be inserted.

COLUMN 8:
Line 22, "an electricity" should read --electricity--.
Line 23, "an electricity" should read --electricity--.

COLUMN 9:
Line 35, "an electricity" should read --electricity--.

COLUMN 10:
Line 53, "case," should read --cases,--.

COLUMN 11:
Line 44, "an electricity" should read --electricity--.

COLUMN 14:
Line 46, "well-known" should read --well-known,--.

COLUMN 20:
Line 63, "descried" should read --described--.

COLUMN 21:
Line 15, "an" should be deleted.
Line 21, "an" should be deleted.

UNITED STATES PATENT AND TRADEMARK OFFICE

CERTIFICATE OF CORRECTION

PATENT NO. : 5,969,730

DATED : October 19, 1999

INVENTOR(S) : SHIGERU INOSE, ET AL.

It is certified that error appears in the above-identified patent and that said Letters Patent is hereby corrected as shown below:

COLUMN 22:
Line 25, "to" should read --and--.
Line 27, "to" should read --and--.
Line 28, "to 7R" should read --and 7B--.
Line 40, "1,395" should read --1395th--.

COLUMN 27:
Line 16, "traducers" should read --transducers--.
Line 39, "internal" should be deleted.

COLUMN 32:
Line 15, "a arrayed" should read --an arrayed--.

Signed and Sealed this

Twenty-second Day of August, 2000

*Attest:*

Q. TODD DICKINSON

*Attesting Officer*

*Director of Patents and Trademarks*